US010299990B2

(12) United States Patent
Lev et al.

(10) Patent No.: US 10,299,990 B2
(45) Date of Patent: May 28, 2019

(54) LIQUID DRUG TRANSFER DEVICES

(71) Applicant: MEDIMOP Medical Projects Ltd., Ra'anana (IL)

(72) Inventors: Nimrod Lev, Savion (IL); Niv Ben Shalom, Netanya (IL)

(73) Assignee: West Pharma. Services IL, Ltd., Ra'anana (IL)

( * ) Notice: Subject to any disclaimer, the term of this patent is extended or adjusted under 35 U.S.C. 154(b) by 16 days.

(21) Appl. No.: 15/653,610

(22) Filed: Jul. 19, 2017

(65) Prior Publication Data

US 2017/0312175 A1 Nov. 2, 2017

Related U.S. Application Data

(62) Division of application No. 14/423,595, filed as application No. PCT/IL2013/050706 on Aug. 20, 2013, now Pat. No. 9,839,580.

(Continued)

(30) Foreign Application Priority Data

Aug. 26, 2012 (IL) ..... 221,634

(51) Int. Cl.

| | |
|---|---|
| ***A61J 1/20*** | (2006.01) |
| ***A61J 1/14*** | (2006.01) |
| *A61J 1/10* | (2006.01) |

(52) U.S. Cl.

CPC ..... *A61J 1/20* (2013.01); *A61J 1/1406* (2013.01); *A61J 1/2055* (2015.05); *A61J 1/2089* (2013.01);

(Continued)

(58) Field of Classification Search

CPC ..... A61J 1/20; A61J 1/2055; A61J 1/1406; A61J 1/2089; A61J 1/2096; A61J 1/201;

(Continued)

(56) References Cited

U.S. PATENT DOCUMENTS

| | | | |
|---|---|---|---|
| 62,333 | A | 2/1867 | Holl |
| 247,975 | A | 10/1881 | Wickes |

(Continued)

FOREIGN PATENT DOCUMENTS

| | | | |
|---|---|---|---|
| CN | 1636605 | A | 7/2005 |
| CN | 1747683 | A | 3/2006 |

(Continued)

OTHER PUBLICATIONS

Grifols Vial Adapter Product Literature, 2 pages, Jan. 2002.

(Continued)

*Primary Examiner* — Philip R Wiest
(74) *Attorney, Agent, or Firm* — Panitch Schwarze Belisario & Nadel LLP

(57) ABSTRACT

Liquid drug transfer devices with universal drug vial adapters for use with a drug vial of a small drug vial and a large drug vial. Some universal drug vial adapters employ the same generally opposite upright flex members for clamping a small drug vial and a large drug vial. Other universal drug vial adapters include a set of minor flex members for clamping a small drug vial and a set of major flex members encircling the set of minor flex members for clamping a large drug vial whereupon the large drug vial underlies the set of minor flex members. Liquid drug transfer devices with a universal injection port connector for attachment on an injection port of an infusion bag.

1 Claim, 26 Drawing Sheets

Related U.S. Application Data

(60) Provisional application No. 61/731,574, filed on Nov. 30, 2012.

(52) U.S. Cl.
CPC ..... *A61J 1/2096* (2013.01); *A61J 1/10* (2013.01); *A61J 1/201* (2015.05); *A61J 1/2013* (2015.05); *A61J 1/2048* (2015.05); *A61J 1/2051* (2015.05)

(58) Field of Classification Search
CPC ..... A61J 1/2013; A61J 1/2048; A61J 1/2051; A61J 1/10
See application file for complete search history.

(56) References Cited

U.S. PATENT DOCUMENTS 254,444 A 2/1882 Vogel
300,060 A 6/1884 Ford
1,021,681 A 3/1912 Jennings
1,704,817 A 3/1929 Ayers
1,930,944 A 10/1933 Schmitz, Jr.
2,326,490 A 8/1943 Perelson
2,560,162 A 7/1951 Garwood
2,748,769 A 6/1956 Huber
2,830,587 A 4/1958 Everett
2,931,668 A 4/1960 Baley
2,968,497 A 1/1961 Treleman
3,059,643 A 10/1962 Barton
D198,499 S 6/1964 Harautuneian
3,225,763 A 12/1965 Waterman
3,277,893 A 10/1966 Clark
3,308,822 A 3/1967 De Luca
3,484,849 A 12/1969 Huebner et al.
3,618,637 A 11/1971 Santomieri
3,757,981 A 9/1973 Harris, Sr. et al.
3,782,365 A 1/1974 Pinna
3,788,524 A 1/1974 Davis et al.
3,822,700 A 7/1974 Pennington
3,826,261 A 7/1974 Killinger
3,872,992 A 3/1975 Larson
3,885,607 A 5/1975 Peltier
3,938,520 A 2/1976 Scislowicz et al.
3,957,052 A 5/1976 Topham
3,977,555 A 8/1976 Larson
3,993,063 A 11/1976 Larrabee
4,020,839 A 5/1977 Klapp
4,026,128 A 5/1977 Blanco
4,051,852 A 10/1977 Villari
D247,975 S 5/1978 Luther
D248,568 S 7/1978 Ismach
4,109,670 A 8/1978 Slagel
4,121,585 A 10/1978 Becker, Jr.
4,161,178 A 7/1979 Genese
4,187,848 A 2/1980 Taylor
D254,444 S 3/1980 Levine
4,203,067 A 5/1980 Fitzky et al.
4,203,443 A 5/1980 Genese
4,210,173 A 7/1980 Choksi et al.
D257,286 S 10/1980 Folkman
4,253,501 A 3/1981 Ogle
4,296,786 A 10/1981 Brignola
4,303,067 A 12/1981 Connolly et al.
4,312,349 A 1/1982 Cohen
4,314,586 A 2/1982 Folkman
4,328,802 A 5/1982 Curley et al.
4,335,717 A 6/1982 Bujan et al.
D267,199 S 12/1982 Koenig
4,376,634 A 3/1983 Prior et al.
D268,871 S 5/1983 Benham et al.
4,392,850 A 7/1983 Elias et al.
D270,282 S 8/1983 Gross
4,410,321 A 10/1983 Pearson et al.
4,411,662 A 10/1983 Pearson
D271,421 S 11/1983 Fetterman
4,434,823 A 3/1984 Hudspith
4,465,471 A 8/1984 Harris et al.
4,475,915 A 10/1984 Sloane
4,493,348 A 1/1985 Lemmons
4,505,709 A 3/1985 Froning et al.
4,507,113 A 3/1985 Dunlap
D280,018 S 8/1985 Scott
4,532,969 A 8/1985 Kwaan
4,564,054 A 1/1986 Gustavsson
4,573,993 A 3/1986 Hoag et al.
4,576,211 A 3/1986 Valentini et al.
4,581,014 A 4/1986 Millerd et al.
4,585,446 A 4/1986 Kempf
4,588,396 A 5/1986 Stroebel et al.
4,588,403 A 5/1986 Weiss et al.
D284,603 S 7/1986 Loignon
4,604,093 A 8/1986 Brown et al.
4,607,671 A 8/1986 Aalto et al.
4,614,437 A 9/1986 Buehler
4,638,975 A 1/1987 Iuchi et al.
4,639,019 A 1/1987 Mittleman
4,667,927 A 5/1987 Oscarsson
4,675,020 A 6/1987 McPhee
4,676,530 A 6/1987 Nordgren et al.
4,683,975 A 8/1987 Booth et al.
4,697,622 A 10/1987 Swift et al.
4,721,133 A 1/1988 Sundblom
4,729,401 A 3/1988 Raines
4,735,608 A 4/1988 Sardam
4,743,229 A 5/1988 Chu
4,743,243 A 5/1988 Vaillancourt
4,752,292 A 6/1988 Lopez et al.
4,758,235 A 7/1988 Tu
4,759,756 A 7/1988 Forman et al.
4,778,447 A 10/1988 Velde et al.
4,787,898 A 11/1988 Raines
4,797,898 A 1/1989 Martinez
D300,060 S 2/1989 Molgaard-Nielsen
4,804,366 A 2/1989 Zdeb et al.
4,826,492 A 5/1989 Magasi
4,832,690 A 5/1989 Kuu
4,834,152 A 5/1989 Howson et al.
D303,013 S 8/1989 Konopka
4,857,062 A 8/1989 Russell
4,865,592 A 9/1989 Rycroft
4,871,463 A 10/1989 Taylor et al.
4,898,209 A 2/1990 Zbed
4,909,290 A 3/1990 Coccia
4,919,596 A 4/1990 Slate et al.
4,927,423 A 5/1990 Malmborg
4,931,040 A 6/1990 Haber et al.
4,932,944 A 6/1990 Jagger et al.
4,967,797 A 11/1990 Manska
D314,050 S 1/1991 Sone
D314,622 S 2/1991 Andersson et al.
4,997,430 A 3/1991 Van der Heiden et al.
5,006,114 A 4/1991 Rogers et al.
5,035,686 A 7/1991 Crittenden et al.
5,041,105 A 8/1991 D'Alo et al.
5,045,066 A 9/1991 Scheuble et al.
5,049,129 A 9/1991 Zdeb et al.
5,053,015 A 10/1991 Gross
5,061,248 A 10/1991 Sacco
5,088,996 A 2/1992 Kopfer et al.
5,096,575 A 3/1992 Cosack
5,104,387 A 4/1992 Pokorney et al.
5,113,904 A 5/1992 Aslanian
5,122,124 A 6/1992 Novacek et al.
5,125,908 A 6/1992 Cohen
5,125,915 A 6/1992 Berry et al.
D328,788 S 8/1992 Sagae et al.
5,171,230 A 12/1992 Eland et al.
5,201,705 A 4/1993 Berglund et al.
5,201,717 A 4/1993 Wyatt et al.
5,203,771 A 4/1993 Melker et al.
5,203,775 A 4/1993 Frank et al.
5,211,638 A 5/1993 Dudar et al.
5,232,029 A 8/1993 Knox et al.

(56) References Cited

U.S. PATENT DOCUMENTS 5,232,109 A 8/1993 Tirrell et al.
5,242,432 A 9/1993 DeFrank
5,247,972 A 9/1993 Tetreault
D341,420 S 11/1993 Conn
5,269,768 A 12/1993 Cheung
5,270,219 A 12/1993 DeCastro et al.
5,279,576 A 1/1994 Loo et al.
5,288,290 A 2/1994 Brody
5,300,034 A 4/1994 Behnke et al.
5,301,685 A 4/1994 Guirguis
5,304,163 A 4/1994 Bonnici et al.
5,304,165 A 4/1994 Haber et al.
5,308,483 A 5/1994 Sklar et al.
5,312,377 A 5/1994 Dalton
5,328,474 A 7/1994 Raines
D349,648 S 8/1994 Tirrell et al.
5,334,163 A 8/1994 Sinnett
5,334,179 A 8/1994 Poli et al.
5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.

(56) References Cited

U.S. PATENT DOCUMENTS

| | | | |
|---|---|---|---|
| 6,080,132 | A | 6/2000 | Cole et al. |
| D428,141 | S | 7/2000 | Brotspies et al. |
| 6,086,762 | A | 7/2000 | Guala |
| 6,089,541 | A | 7/2000 | Weinheimer et al. |
| 6,090,091 | A | 7/2000 | Fowles et al. |
| 6,090,093 | A | 7/2000 | Thibault et al. |
| 6,092,692 | A | 7/2000 | Riskin |
| D430,291 | S | 8/2000 | Jansen et al. |
| 6,099,511 | A | 8/2000 | Devos et al. |
| 6,113,068 | A | 9/2000 | Ryan |
| 6,113,583 | A | 9/2000 | Fowles et al. |
| 6,117,114 | A | 9/2000 | Paradis |
| D431,864 | S | 10/2000 | Jansen |
| 6,139,534 | A | 10/2000 | Niedospial, Jr. et al. |
| 6,142,446 | A | 11/2000 | Leinsing |
| 6,146,362 | A | 11/2000 | Turnbull et al. |
| 6,149,623 | A | 11/2000 | Reynolds |
| 6,156,025 | A | 12/2000 | Niedospial, Jr. et al. |
| 6,159,192 | A | 12/2000 | Fowles et al. |
| 6,168,037 | B1 | 1/2001 | Grimard |
| 6,171,287 | B1 | 1/2001 | Lynn et al. |
| 6,171,293 | B1 | 1/2001 | Rowley et al. |
| 6,173,852 | B1 | 1/2001 | Browne |
| 6,173,868 | B1 | 1/2001 | DeJonge |
| 6,174,304 | B1 | 1/2001 | Weston |
| 6,179,822 | B1 | 1/2001 | Niedospial, Jr. |
| 6,179,823 | B1 | 1/2001 | Niedospial, Jr. |
| 6,206,861 | B1 | 3/2001 | Mayer |
| 6,221,041 | B1 | 4/2001 | Russo |
| 6,221,054 | B1 | 4/2001 | Martin et al. |
| 6,221,065 | B1 | 4/2001 | Davis |
| 6,238,372 | B1 | 5/2001 | Zinger et al. |
| 6,245,044 | B1 | 6/2001 | Daw et al. |
| D445,501 | S | 7/2001 | Niedospial, Jr. |
| D445,895 | S | 7/2001 | Svendsen |
| 6,253,804 | B1 | 7/2001 | Safabash |
| 6,258,078 | B1 | 7/2001 | Thilly |
| 6,280,430 | B1 | 8/2001 | Neftel et al. |
| 6,290,688 | B1 | 9/2001 | Lopez et al. |
| 6,296,621 | B1 | 10/2001 | Masuda et al. |
| 6,299,131 | B1 | 10/2001 | Ryan |
| 6,343,629 | B1 | 2/2002 | Wessman et al. |
| 6,348,044 | B1 | 2/2002 | Coletti et al. |
| 6,358,236 | B1 | 3/2002 | DeFoggi et al. |
| 6,364,866 | B1 | 4/2002 | Furr et al. |
| 6,378,576 | B2 | 4/2002 | Thibault et al. |
| 6,378,714 | B1 | 4/2002 | Jansen et al. |
| 6,379,340 | B1 | 4/2002 | Zinger et al. |
| D457,954 | S | 5/2002 | Wallace et al. |
| 6,382,442 | B1 | 5/2002 | Thibault et al. |
| 6,386,397 | B2 | 5/2002 | Brotspies et al. |
| 6,408,897 | B1 | 6/2002 | Laurent et al. |
| 6,409,708 | B1 | 6/2002 | Wessman |
| 6,440,107 | B1 | 8/2002 | Trombley, III et al. |
| 6,453,949 | B1 | 9/2002 | Chau |
| 6,453,956 | B2 | 9/2002 | Safabash |
| 6,474,375 | B2 | 11/2002 | Spero et al. |
| 6,478,788 | B1 | 11/2002 | Aneas |
| D468,015 | S | 12/2002 | Horppu |
| 6,499,617 | B1 | 12/2002 | Niedospial, Jr. et al. |
| 6,503,240 | B1 | 1/2003 | Niedospial, Jr. et al. |
| 6,503,244 | B2 | 1/2003 | Hayman |
| 6,520,932 | B2 | 2/2003 | Taylor |
| 6,524,278 | B1 | 2/2003 | Campbell et al. |
| 6,524,295 | B2 | 2/2003 | Daubert et al. |
| D472,316 | S | 3/2003 | Douglas et al. |
| 6,530,903 | B2 | 3/2003 | Wang et al. |
| 6,537,263 | B1 | 3/2003 | Aneas |
| D472,630 | S | 4/2003 | Douglas et al. |
| 6,544,246 | B1 | 4/2003 | Niedospial, Jr. |
| 6,551,299 | B2 | 4/2003 | Miyoshi et al. |
| 6,558,365 | B2 | 5/2003 | Zinger et al. |
| 6,571,837 | B2 | 6/2003 | Jansen et al. |
| 6,572,591 | B2 | 6/2003 | Mayer |
| 6,575,955 | B2 | 6/2003 | Azzolini |
| 6,581,593 | B1 | 6/2003 | Rubin et al. |
| 6,582,415 | B1 | 6/2003 | Fowles et al. |
| D476,731 | S | 7/2003 | Cise et al. |
| 6,591,876 | B2 | 7/2003 | Safabash |
| 6,599,273 | B1 | 7/2003 | Lopez |
| 6,601,721 | B2 | 8/2003 | Jansen et al. |
| 6,626,309 | B1 | 9/2003 | Jansen et al. |
| 6,632,201 | B1 | 10/2003 | Mathias et al. |
| 6,638,244 | B1 | 10/2003 | Reynolds |
| D482,121 | S | 11/2003 | Harding et al. |
| D482,447 | S | 11/2003 | Harding et al. |
| 6,651,956 | B2 | 11/2003 | Miller |
| 6,652,509 | B1 | 11/2003 | Helgren et al. |
| D483,487 | S | 12/2003 | Harding et al. |
| D483,869 | S | 12/2003 | Tran et al. |
| 6,656,433 | B2 | 12/2003 | Sasso |
| 6,666,852 | B2 | 12/2003 | Niedospial, Jr. |
| 6,681,810 | B2 | 1/2004 | Weston |
| 6,681,946 | B1 | 1/2004 | Jansen et al. |
| 6,682,509 | B2 | 1/2004 | Lopez |
| 6,692,478 | B1 | 2/2004 | Paradis |
| 6,692,829 | B2 | 2/2004 | Stubler et al. |
| 6,695,829 | B2 | 2/2004 | Hellstrom et al. |
| 6,699,229 | B2 | 3/2004 | Zinger et al. |
| 6,706,022 | B1 | 3/2004 | Leinsing et al. |
| 6,706,031 | B2 | 3/2004 | Manera |
| 6,715,520 | B2 | 4/2004 | Andreasson et al. |
| 6,729,370 | B2 | 5/2004 | Norton et al. |
| 6,736,798 | B2 | 5/2004 | Ohkubo et al. |
| 6,745,998 | B2 | 6/2004 | Doyle |
| 6,746,438 | B1 | 6/2004 | Amissolle |
| 6,752,180 | B2 | 6/2004 | Delay |
| D495,416 | S | 8/2004 | Dimeo et al. |
| D496,457 | S | 9/2004 | Prais et al. |
| 6,802,490 | B2 | 10/2004 | Leinsing et al. |
| 6,832,994 | B2 | 12/2004 | Niedospial, Jr. et al. |
| 6,852,103 | B2 | 2/2005 | Fowles et al. |
| 6,875,203 | B1 | 4/2005 | Fowles et al. |
| 6,875,205 | B2 | 4/2005 | Leinsing |
| 6,878,131 | B2 | 4/2005 | Novacek et al. |
| 6,884,253 | B1 | 4/2005 | McFarlane |
| 6,890,328 | B2 | 5/2005 | Fowles et al. |
| D506,256 | S | 6/2005 | Miyoshi et al. |
| 6,901,975 | B2 | 6/2005 | Aramata et al. |
| 6,945,417 | B2 | 9/2005 | Jansen et al. |
| 6,948,522 | B2 | 9/2005 | Newbrough et al. |
| 6,949,086 | B2 | 9/2005 | Ferguson et al. |
| 6,951,613 | B2 | 10/2005 | Reif et al. |
| 6,957,745 | B2 | 10/2005 | Thibault et al. |
| 6,960,164 | B2 | 11/2005 | O'Heeron |
| 6,972,002 | B2 | 12/2005 | Thorne |
| 6,979,318 | B1 | 12/2005 | McDonald et al. |
| RE38,996 | E | 2/2006 | Crawford et al. |
| 6,994,315 | B2 | 2/2006 | Ryan et al. |
| 6,997,916 | B2 | 2/2006 | Simas, Jr. et al. |
| 6,997,917 | B2 | 2/2006 | Niedospial, Jr. et al. |
| 7,024,968 | B2 | 4/2006 | Raudabough et al. |
| 7,070,589 | B2 | 7/2006 | Lolachi et al. |
| 7,074,216 | B2 | 7/2006 | Fowles et al. |
| 7,083,600 | B2 | 8/2006 | Meloul |
| 7,086,431 | B2 | 8/2006 | D'Antonio et al. |
| 7,097,637 | B2 | 8/2006 | Triplett et al. |
| 7,100,890 | B2 | 9/2006 | Cote, Sr. et al. |
| 7,140,401 | B2 | 11/2006 | Wilcox et al. |
| 7,150,735 | B2 | 12/2006 | Hickle |
| 7,192,423 | B2 | 3/2007 | Wong |
| 7,195,623 | B2 | 3/2007 | Burroughs et al. |
| 7,241,285 | B1 | 7/2007 | Dikeman |
| 7,294,122 | B2 | 11/2007 | Kubo et al. |
| 7,306,199 | B2 | 12/2007 | Leinsing et al. |
| D561,348 | S | 2/2008 | Zinger et al. |
| 7,326,188 | B1 | 2/2008 | Russell et al. |
| 7,326,194 | B2 | 2/2008 | Zinger et al. |
| 7,350,764 | B2 | 4/2008 | Raybuck |
| 7,354,422 | B2 | 4/2008 | Riesenberger et al. |
| 7,354,427 | B2 | 4/2008 | Fangrow |
| 7,425,209 | B2 | 9/2008 | Fowles et al. |
| 7,435,246 | B2 | 10/2008 | Zihlmann |
| D580,558 | S | 11/2008 | Shigesada et al. |

(56) References Cited

U.S. PATENT DOCUMENTS

| | | | |
|---|---|---|---|
| 7,452,348 | B2 | 11/2008 | Hasegawa |
| 7,470,257 | B2 | 12/2008 | Norton et al. |
| 7,470,265 | B2 | 12/2008 | Brugger et al. |
| 7,472,932 | B2 | 1/2009 | Weber et al. |
| 7,488,297 | B2 | 2/2009 | Flaherty |
| 7,491,197 | B2 | 2/2009 | Jansen et al. |
| 7,497,848 | B2 | 3/2009 | Leinsing et al. |
| 7,523,967 | B2 | 4/2009 | Steppe |
| 7,530,546 | B2 | 5/2009 | Ryan et al. |
| D595,420 | S | 6/2009 | Suzuki et al. |
| D595,421 | S | 6/2009 | Suzuki et al. |
| 7,540,863 | B2 | 6/2009 | Haindl |
| 7,540,865 | B2 | 6/2009 | Griffin et al. |
| 7,544,191 | B2 | 6/2009 | Peluso et al. |
| D595,862 | S | 7/2009 | Suzuki et al. |
| D595,863 | S | 7/2009 | Suzuki et al. |
| 7,611,487 | B2 | 11/2009 | Woehr et al. |
| 7,611,502 | B2 | 11/2009 | Daly |
| 7,615,041 | B2 | 11/2009 | Sullivan et al. |
| 7,628,779 | B2 | 12/2009 | Aneas |
| 7,632,261 | B2 | 12/2009 | Zinger et al. |
| D608,900 | S | 1/2010 | Giraud et al. |
| 7,654,995 | B2 | 2/2010 | Warren et al. |
| 7,670,326 | B2 | 3/2010 | Shemesh |
| 7,695,445 | B2 | 4/2010 | Yuki |
| 7,704,229 | B2 | 4/2010 | Moberg et al. |
| D616,090 | S | 5/2010 | Kawamura |
| 7,713,247 | B2 | 5/2010 | Lopez |
| 7,717,886 | B2 | 5/2010 | Lopez |
| 7,722,090 | B2 | 5/2010 | Burton et al. |
| D616,984 | S | 6/2010 | Gilboa |
| 7,731,678 | B2 | 6/2010 | Tennican et al. |
| 7,743,799 | B2 | 6/2010 | Mosler et al. |
| 7,744,581 | B2 | 6/2010 | Wallen et al. |
| 7,757,901 | B2 | 7/2010 | Welp |
| 7,758,082 | B2 | 7/2010 | Weigel et al. |
| 7,758,560 | B2 | 7/2010 | Connell et al. |
| 7,762,524 | B2 | 7/2010 | Cawthon et al. |
| 7,766,304 | B2 | 8/2010 | Phillips |
| 7,771,383 | B2 | 8/2010 | Truitt et al. |
| D624,641 | S | 9/2010 | Boclet |
| 7,799,009 | B2 | 9/2010 | Niedospial, Jr. et al. |
| 7,803,140 | B2 | 9/2010 | Fangrow, Jr. |
| D627,216 | S | 11/2010 | Fulginiti |
| D630,732 | S | 1/2011 | Lev et al. |
| 7,862,537 | B2 | 1/2011 | Zinger et al. |
| 7,867,215 | B2 | 1/2011 | Akerlund et al. |
| 7,879,018 | B2 | 2/2011 | Zinger et al. |
| 7,895,216 | B2 | 2/2011 | Longshaw et al. |
| D634,007 | S | 3/2011 | Zinger et al. |
| 7,900,659 | B2 | 3/2011 | Whitley et al. |
| D637,713 | S | 5/2011 | Nord et al. |
| D641,080 | S | 7/2011 | Zinger et al. |
| 7,985,216 | B2 | 7/2011 | Daily et al. |
| D644,104 | S | 8/2011 | Maeda et al. |
| 7,993,328 | B2 | 8/2011 | Whitley |
| 8,007,461 | B2 | 8/2011 | Huo et al. |
| 8,012,132 | B2 | 9/2011 | Lum et al. |
| 8,016,809 | B2 | 9/2011 | Zinger et al. |
| 8,021,325 | B2 | 9/2011 | Zinger et al. |
| 8,025,653 | B2 | 9/2011 | Capitaine et al. |
| 8,025,683 | B2 | 9/2011 | Morrison |
| 8,029,472 | B2 | 10/2011 | Leinsing et al. |
| 8,038,123 | B2 | 10/2011 | Ruschke et al. |
| 8,066,688 | B2 | 11/2011 | Zinger et al. |
| 8,070,739 | B2 | 12/2011 | Zinger et al. |
| 8,075,550 | B2 | 12/2011 | Nord et al. |
| 8,096,525 | B2 | 1/2012 | Ryan |
| 8,105,314 | B2 | 1/2012 | Fangrow, Jr. |
| D654,166 | S | 2/2012 | Lair |
| D655,017 | S | 2/2012 | Mosler et al. |
| 8,122,923 | B2 | 2/2012 | Kraus et al. |
| 8,123,736 | B2 | 2/2012 | Kraushaar et al. |
| D655,071 | S | 3/2012 | Davila |
| D657,461 | S | 4/2012 | Schembre et al. |
| 8,152,779 | B2 | 4/2012 | Cabiri |
| 8,157,784 | B2 | 4/2012 | Rogers |
| 8,167,863 | B2 | 5/2012 | Yow |
| 8,172,824 | B2 | 5/2012 | Pfeifer et al. |
| 8,177,768 | B2 | 5/2012 | Leinsing |
| 8,182,452 | B2 | 5/2012 | Mansour et al. |
| 8,187,248 | B2 | 5/2012 | Zihlmann |
| 8,196,614 | B2 | 6/2012 | Kriheli |
| 8,197,459 | B2 | 6/2012 | Jansen et al. |
| 8,211,069 | B2 | 7/2012 | Fangrow, Jr. |
| 8,225,959 | B2 | 7/2012 | Lambrecht |
| 8,241,268 | B2 | 8/2012 | Whitley |
| 8,262,628 | B2 | 9/2012 | Fangrow, Jr. |
| 8,262,641 | B2 | 9/2012 | Vedrine et al. |
| 8,267,127 | B2 | 9/2012 | Kriheli |
| D669,980 | S | 10/2012 | Lev et al. |
| 8,287,513 | B2 | 10/2012 | Ellstrom et al. |
| 8,328,784 | B2 | 12/2012 | Jensen et al. |
| D673,673 | S | 1/2013 | Wang |
| D674,084 | S | 1/2013 | Linnenschmidt |
| D674,088 | S | 1/2013 | Lev et al. |
| 8,348,898 | B2 | 1/2013 | Cabiri |
| D681,230 | S | 4/2013 | Mosler et al. |
| 8,454,573 | B2 | 6/2013 | Wyatt et al. |
| 8,469,939 | B2 | 6/2013 | Fangrow, Jr. |
| 8,475,404 | B2 | 7/2013 | Foshee et al. |
| 8,480,645 | B1 | 7/2013 | Choudhury et al. |
| 8,480,646 | B2 | 7/2013 | Nord et al. |
| 8,506,548 | B2 | 8/2013 | Okiyama |
| 8,511,352 | B2 | 8/2013 | Kraus et al. |
| 8,512,309 | B2 | 8/2013 | Shemesh et al. |
| D690,009 | S | 9/2013 | Schembre et al. |
| D690,418 | S | 9/2013 | Rosenquist |
| 8,523,837 | B2 | 9/2013 | Wiggins et al. |
| 8,545,476 | B2 | 10/2013 | Ariagno et al. |
| 8,551,067 | B2 | 10/2013 | Zinger et al. |
| 8,556,879 | B2 | 10/2013 | Okiyama |
| 8,562,582 | B2 | 10/2013 | Tuckwell et al. |
| 8,608,723 | B2 | 12/2013 | Lev et al. |
| 8,628,508 | B2 | 1/2014 | Weitzel et al. |
| 8,684,992 | B2 | 4/2014 | Sullivan et al. |
| 8,684,994 | B2 | 4/2014 | Lev et al. |
| 8,752,598 | B2 | 6/2014 | Denenburg et al. |
| D714,935 | S | 10/2014 | Nishioka et al. |
| D717,406 | S | 11/2014 | Stanley et al. |
| D717,948 | S | 11/2014 | Strong et al. |
| D719,650 | S | 12/2014 | Arinobe et al. |
| D720,067 | S | 12/2014 | Rosenquist |
| D720,451 | S | 12/2014 | Denenburg et al. |
| D720,452 | S | 12/2014 | Jordan |
| 8,900,212 | B2 | 12/2014 | Kubo |
| 8,905,994 | B1 | 12/2014 | Lev et al. |
| 8,915,882 | B2 | 12/2014 | Cabiri |
| D720,850 | S | 1/2015 | Hsia et al. |
| D732,660 | S | 6/2015 | Ohashi |
| D732,664 | S | 6/2015 | Woehr et al. |
| D733,291 | S | 6/2015 | Wang |
| D733,292 | S | 6/2015 | Rogers |
| D733,293 | S | 6/2015 | Rogers |
| 9,072,827 | B2 | 7/2015 | Cabiri |
| D738,494 | S | 9/2015 | Kashmirian |
| D741,457 | S | 10/2015 | Guest |
| 9,149,575 | B2 | 10/2015 | Cabiri |
| D750,235 | S | 2/2016 | Maurice |
| D757,933 | S | 5/2016 | Lev et al. |
| 9,393,365 | B2 | 7/2016 | Cabiri |
| 9,486,391 | B2 | 11/2016 | Shemesh |
| 9,492,610 | B2 | 11/2016 | Cabiri |
| 9,511,190 | B2 | 12/2016 | Cabiri |
| 9,522,234 | B2 | 12/2016 | Cabiri |
| D794,183 | S | 8/2017 | Lev et al. |
| 9,763,855 | B2 | 9/2017 | Fangrow |
| 2001/0000347 | A1 | 4/2001 | Hellstrom et al. |
| 2001/0025671 | A1 | 10/2001 | Safabash |
| 2001/0029360 | A1 | 10/2001 | Miyoshi et al. |
| 2001/0051793 | A1 | 12/2001 | Weston |
| 2002/0017328 | A1 | 2/2002 | Loo |
| 2002/0055711 | A1 | 5/2002 | Lavi et al. |
| 2002/0065488 | A1 | 5/2002 | Suzuki et al. |

(56) References Cited

U.S. PATENT DOCUMENTS

2002/0066715 A1 6/2002 Niedospial
2002/0087118 A1 7/2002 Reynolds et al.
2002/0087141 A1 7/2002 Zinger et al.
2002/0087144 A1 7/2002 Zinger et al.
2002/0121496 A1 9/2002 Thiebault et al.
2002/0123736 A1 9/2002 Fowles et al.
2002/0127150 A1 9/2002 Sasso
2002/0128628 A1 9/2002 Fathallah
2002/0138045 A1 9/2002 Moen
2002/0173752 A1 11/2002 Polzin
2002/0193777 A1 12/2002 Aneas
2003/0028156 A1 2/2003 Juliar
2003/0036725 A1 2/2003 Lavi et al.
2003/0068354 A1 4/2003 Reif et al.
2003/0069550 A1 4/2003 Sharp
2003/0073971 A1 4/2003 Saker
2003/0100866 A1 5/2003 Reynolds
2003/0109846 A1 6/2003 Zinger et al.
2003/0120209 A1 6/2003 Jensen et al.
2003/0135159 A1 7/2003 Daily et al.
2003/0153895 A1 8/2003 Leinsing
2003/0187420 A1 10/2003 Akerlund et al.
2003/0191445 A1 10/2003 Wallen et al.
2003/0195479 A1 10/2003 Kuracina et al.
2003/0199827 A1 10/2003 Thorne
2003/0199846 A1 10/2003 Fowles et al.
2003/0199847 A1 10/2003 Akerlund et al.
2003/0205843 A1 11/2003 Adams
2003/0236543 A1 12/2003 Brenneman et al.
2004/0010207 A1 1/2004 Flaherty et al.
2004/0024354 A1 2/2004 Reynolds
2004/0039365 A1 2/2004 Aramata et al.
2004/0044327 A1 3/2004 Hasegawa
2004/0073189 A1 4/2004 Wyatt et al.
2004/0143218 A1 7/2004 Das
2004/0143226 A1 7/2004 Marsden
2004/0153047 A1 8/2004 Blank et al.
2004/0158172 A1 8/2004 Hancock
2004/0162540 A1 8/2004 Walenciak et al.
2004/0167472 A1 8/2004 Howell et al.
2004/0181192 A1 9/2004 Cuppy
2004/0186424 A1 9/2004 Hjertman
2004/0199139 A1 10/2004 Fowles et al.
2004/0204699 A1 10/2004 Hanly et al.
2004/0217315 A1 11/2004 Doyle
2004/0225274 A1 11/2004 Jansen et al.
2004/0236305 A1 11/2004 Jansen et al.
2004/0249341 A1 12/2004 Newbrough et al.
2004/0255952 A1 12/2004 Carlsen et al.
2005/0015070 A1 1/2005 Delnevo et al.
2005/0016626 A1 1/2005 Wilcox et al.
2005/0049553 A1 3/2005 Triplett et al.
2005/0055008 A1 3/2005 Paradis et al.
2005/0082828 A1 4/2005 Wicks et al.
2005/0124964 A1 6/2005 Niedospial et al.
2005/0137523 A1 6/2005 Wyatt et al.
2005/0137566 A1 6/2005 Fowles et al.
2005/0148994 A1 7/2005 Leinsing
2005/0159706 A1 7/2005 Wilkinson et al.
2005/0159724 A1 7/2005 Enerson
2005/0182383 A1 8/2005 Wallen
2005/0209554 A1 9/2005 Landau
2005/0261637 A1 11/2005 Miller
2005/0277896 A1 12/2005 Messerli et al.
2006/0030832 A1 2/2006 Niedospial et al.
2006/0079834 A1 4/2006 Tennican et al.
2006/0089594 A1 4/2006 Landau
2006/0089603 A1 4/2006 Truitt et al.
2006/0095015 A1 5/2006 Hobbs et al.
2006/0106360 A1 5/2006 Wong
2006/0135948 A1 6/2006 Varma
2006/0155257 A1 7/2006 Reynolds
2006/0161192 A1 7/2006 Young
2006/0173410 A1 8/2006 Moberg et al.
2006/0178646 A1 8/2006 Harris et al.
2006/0195029 A1 8/2006 Shults et al.
2006/0212004 A1 9/2006 Atil
2006/0253084 A1 11/2006 Nordgren
2006/0259004 A1 11/2006 Connell et al.
2007/0016381 A1 1/2007 Kamath et al.
2007/0024995 A1 2/2007 Hayashi
2007/0060904 A1 3/2007 Vedrine et al.
2007/0078428 A1 4/2007 Reynolds et al.
2007/0079894 A1 4/2007 Kraus et al.
2007/0083164 A1 4/2007 Barrelle et al.
2007/0088252 A1 4/2007 Pestotnik et al.
2007/0088293 A1 4/2007 Fangrow
2007/0088313 A1 4/2007 Zinger et al.
2007/0106218 A1 5/2007 Yodfat et al.
2007/0106244 A1 5/2007 Mosler et al.
2007/0112324 A1 5/2007 Hamedi-Sangsari
2007/0156112 A1 7/2007 Walsh
2007/0167904 A1 7/2007 Zinger et al.
2007/0167912 A1 7/2007 Causey et al.
2007/0191760 A1 8/2007 Iguchi et al.
2007/0191764 A1 8/2007 Zihlmann
2007/0191767 A1 8/2007 Hennessy et al.
2007/0203451 A1 8/2007 Murakami et al.
2007/0219483 A1 9/2007 Kitani et al.
2007/0244447 A1 10/2007 Capitaine et al.
2007/0244461 A1 10/2007 Fangrow
2007/0244462 A1 10/2007 Fangrow
2007/0244463 A1 10/2007 Warren et al.
2007/0249995 A1 10/2007 Van Manen
2007/0255202 A1 11/2007 Kitani et al.
2007/0265574 A1 11/2007 Tennican et al.
2007/0265581 A1 11/2007 Funamura et al.
2007/0270778 A9 11/2007 Zinger et al.
2007/0287953 A1 12/2007 Ziv et al.
2007/0299404 A1 12/2007 Katoh et al.
2008/0009789 A1 1/2008 Zinger et al.
2008/0009822 A1 1/2008 Enerson
2008/0015496 A1 1/2008 Hamedi-Sangsari
2008/0135051 A1 6/2008 Lee
2008/0172024 A1 7/2008 Yow
2008/0188799 A1 8/2008 Mueller-Beckhaus et al.
2008/0195049 A1 8/2008 Thalmann et al.
2008/0208138 A1 8/2008 Lim et al.
2008/0215015 A1 9/2008 Cindrich et al.
2008/0249473 A1 10/2008 Rutti et al.
2008/0249479 A1 10/2008 Zinger et al.
2008/0249498 A1 10/2008 Fangrow
2008/0262465 A1 10/2008 Zinger et al.
2008/0269687 A1 10/2008 Chong et al.
2008/0275407 A1 11/2008 Scheurer
2008/0287905 A1 11/2008 Hiejima et al.
2008/0294100 A1 11/2008 de Costa et al.
2008/0306439 A1 12/2008 Nelson et al.
2008/0312634 A1 12/2008 Helmerson et al.
2009/0012492 A1 1/2009 Zihlmann
2009/0043253 A1 2/2009 Podaima
2009/0054834 A1 2/2009 Zinger et al.
2009/0054852 A1 2/2009 Takano et al.
2009/0062767 A1 3/2009 Van Antwerp et al.
2009/0076360 A1 3/2009 Brister et al.
2009/0082750 A1 3/2009 Denenburg et al.
2009/0139724 A1 6/2009 Gray et al.
2009/0143758 A1 6/2009 Okiyama
2009/0177177 A1 7/2009 Zinger et al.
2009/0177178 A1 7/2009 Pedersen
2009/0187140 A1 7/2009 Racz
2009/0216103 A1 8/2009 Brister et al.
2009/0216212 A1 8/2009 Fangrow, Jr.
2009/0267011 A1 10/2009 Hatton et al.
2009/0299325 A1 12/2009 Vedrine et al.
2009/0318946 A1 12/2009 Tamesada
2009/0326506 A1 12/2009 Hasegawa et al.
2010/0010443 A1 1/2010 Morgan et al.
2010/0016811 A1 1/2010 Smith
2010/0022985 A1 1/2010 Sullivan et al.
2010/0030181 A1 2/2010 Helle et al.
2010/0036319 A1 2/2010 Drake et al.
2010/0076397 A1 3/2010 Reed et al.
2010/0087786 A1 4/2010 Zinger et al.

(56) References Cited

U.S. PATENT DOCUMENTS

| | | | |
|---|---|---|---|
| 2010/0137827 | A1 | 6/2010 | Warren et al. |
| 2010/0137831 | A1 | 6/2010 | Tsals |
| 2010/0152658 | A1 | 6/2010 | Hanson et al. |
| 2010/0160889 | A1 | 6/2010 | Smith et al. |
| 2010/0162548 | A1 | 7/2010 | Leidig |
| 2010/0168664 | A1 | 7/2010 | Zinger et al. |
| 2010/0168712 | A1 | 7/2010 | Tuckwell et al. |
| 2010/0179506 | A1 | 7/2010 | Shemesh et al. |
| 2010/0198148 | A1 | 8/2010 | Zinger et al. |
| 2010/0204670 | A1 | 8/2010 | Kraushaar et al. |
| 2010/0228220 | A1 | 9/2010 | Zinger et al. |
| 2010/0241088 | A1 | 9/2010 | Ranalletta et al. |
| 2010/0274184 | A1 | 10/2010 | Chun |
| 2010/0274202 | A1 | 10/2010 | Hyde et al. |
| 2010/0286661 | A1 | 11/2010 | Raday et al. |
| 2010/0312220 | A1 | 12/2010 | Kalitzki |
| 2011/0004143 | A1 | 1/2011 | Beiriger et al. |
| 2011/0004184 | A1 | 1/2011 | Proksch et al. |
| 2011/0044850 | A1 | 2/2011 | Solomon et al. |
| 2011/0054440 | A1 | 3/2011 | Lewis |
| 2011/0087164 | A1 | 4/2011 | Mosler et al. |
| 2011/0125056 | A1 | 5/2011 | Merchant |
| 2011/0144584 | A1 | 6/2011 | Wozencroft |
| 2011/0160655 | A1 | 6/2011 | Hanson et al. |
| 2011/0160701 | A1 | 6/2011 | Wyatt et al. |
| 2011/0172636 | A1 | 7/2011 | Aasmul |
| 2011/0175347 | A1 | 7/2011 | Okiyama |
| 2011/0218511 | A1 | 9/2011 | Yokoyama |
| 2011/0224640 | A1 | 9/2011 | Kuhn et al. |
| 2011/0230856 | A1 | 9/2011 | Kyle et al. |
| 2011/0264037 | A1 | 10/2011 | Foshee et al. |
| 2011/0264069 | A1 | 10/2011 | Bochenko |
| 2011/0276007 | A1 | 11/2011 | Denenburg |
| 2011/0319827 | A1 | 12/2011 | Leinsing et al. |
| 2012/0022344 | A1 | 1/2012 | Kube |
| 2012/0022469 | A1 | 1/2012 | Alpert |
| 2012/0053555 | A1 | 3/2012 | Ariagno et al. |
| 2012/0059332 | A1 | 3/2012 | Woehr et al. |
| 2012/0059346 | A1 | 3/2012 | Sheppard et al. |
| 2012/0067429 | A1 | 3/2012 | Mosler et al. |
| 2012/0071819 | A1 | 3/2012 | Bruggemann et al. |
| 2012/0078214 | A1 | 3/2012 | Finke et al. |
| 2012/0123382 | A1 | 5/2012 | Kubo |
| 2012/0184938 | A1 | 7/2012 | Lev et al. |
| 2012/0215182 | A1 | 8/2012 | Mansour et al. |
| 2012/0220977 | A1 | 8/2012 | Yow |
| 2012/0220978 | A1 | 8/2012 | Lev et al. |
| 2012/0265163 | A1 | 10/2012 | Cheng et al. |
| 2012/0271229 | A1 | 10/2012 | Lev et al. |
| 2012/0296307 | A1 | 11/2012 | Holt et al. |
| 2012/0310203 | A1 | 12/2012 | Khaled et al. |
| 2012/0323172 | A1 | 12/2012 | Lev et al. |
| 2012/0323187 | A1 | 12/2012 | Iwase et al. |
| 2012/0323210 | A1 | 12/2012 | Lev et al. |
| 2013/0046269 | A1 | 2/2013 | Lev et al. |
| 2013/0053814 | A1 | 2/2013 | Mueller-Beckhaus et al. |
| 2013/0096493 | A1 | 4/2013 | Kubo et al. |
| 2013/0110049 | A1 | 5/2013 | Cronenberg et al. |
| 2013/0144248 | A1 | 6/2013 | Putter et al. |
| 2013/0199669 | A1 | 8/2013 | Moy et al. |
| 2013/0226100 | A1 | 8/2013 | Lev |
| 2013/0231630 | A1 | 9/2013 | Kraus et al. |
| 2013/0237904 | A1 | 9/2013 | Deneburg et al. |
| 2013/0253448 | A1 | 9/2013 | Baron et al. |
| 2013/0289530 | A1 | 10/2013 | Wyatt et al. |
| 2014/0020793 | A1 | 1/2014 | Denenburg et al. |
| 2014/0096862 | A1 | 4/2014 | Aneas |
| 2014/0150911 | A1 | 6/2014 | Hanner et al. |
| 2014/0194854 | A1 | 7/2014 | Tsals |
| 2014/0221940 | A1 | 8/2014 | Clauson et al. |
| 2014/0277052 | A1 | 9/2014 | Haselby et al. |
| 2014/0352845 | A1 | 12/2014 | Lev et al. |
| 2015/0082746 | A1 | 3/2015 | Ivosevic et al. |
| 2015/0088078 | A1 | 3/2015 | Lev et al. |
| 2015/0290390 | A1 | 10/2015 | Ring et al. |
| 2015/0305770 | A1 | 10/2015 | Fill et al. |
| 2016/0088995 | A1 | 3/2016 | Ueda et al. |
| 2016/0199569 | A1 | 7/2016 | Yevmenenko et al. |
| 2016/0228644 | A1 | 8/2016 | Cabiri |
| 2016/0287475 | A1 | 10/2016 | Yevmenenko et al. |

FOREIGN PATENT DOCUMENTS

| | | | |
|---|---|---|---|
| CN | 1863566 | A | 11/2006 |
| CN | 1950049 | A | 4/2007 |
| CN | 101001661 | A | 7/2007 |
| CN | 101687083 | A | 3/2010 |
| DE | 1064693 | B | 9/1959 |
| DE | 1913926 | A1 | 9/1970 |
| DE | 4122476 | A1 | 1/1993 |
| DE | 19504413 | A1 | 8/1996 |
| DE | 202004012714 | U1 | 11/2004 |
| DE | 202009011019 | U1 | 12/2010 |
| EP | 0192661 | A1 | 9/1986 |
| EP | 0195018 | A1 | 9/1986 |
| EP | 0258913 | A2 | 3/1988 |
| EP | 0416454 | A2 | 3/1991 |
| EP | 0282545 | B1 | 2/1992 |
| EP | 0518397 | A1 | 12/1992 |
| EP | 0521460 | A1 | 1/1993 |
| EP | 582038 | A2 | 2/1994 |
| EP | 0598918 | A1 | 6/1994 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887085 | A2 | 12/1998 |
| EP | 0887885 | A2 | 12/1998 |
| EP | 897708 | A2 | 2/1999 |
| EP | 0898951 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| EP | 2512399 | A1 | 10/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| JP | 03-062426 | B | 9/1991 |
| JP | 4329954 | A | 11/1992 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | A | 5/1998 |
| JP | H10-504736 | A | 5/1998 |
| JP | 11503627 | T | 3/1999 |
| JP | 11-319031 | A | 11/1999 |
| JP | 2000-508934 | A | 7/2000 |
| JP | 2000-237278 | A | 9/2000 |

(56) References Cited

FOREIGN PATENT DOCUMENTS

| | | | |
|---|---|---|---|
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |
| JP | 2010-179128 | A | 8/2010 |
| JP | 2012-205769 | A | 10/2012 |
| JP | 2014000220 | A | 1/2014 |
| WO | 8601712 | A1 | 3/1986 |
| WO | 8605683 | A1 | 10/1986 |
| WO | 9003536 | A1 | 4/1990 |
| WO | 9403373 | A1 | 2/1994 |
| WO | 9507066 | A1 | 3/1995 |
| WO | 9600053 | A1 | 1/1996 |
| WO | 9609083 | A1 | 3/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0189607 | A2 | 11/2001 |
| WO | 0191693 | A2 | 12/2001 |
| WO | 0202165 | A2 | 1/2002 |
| WO | 200209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2005002492 | A1 | 1/2005 |
| WO | 2005018703 | A2 | 3/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007101772 | A1 | 9/2007 |
| WO | 2007105221 | A1 | 9/2007 |
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011004360 | A1 | 1/2011 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012004784 | A1 | 1/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014174278 | A1 | 10/2014 |
| WO | 2016023590 | A1 | 2/2016 |

OTHER PUBLICATIONS

Novel Transfer, Mixing and Drug Delivery Systems, MOP Medimop Medical Projects Ltd. Catalog, 4 pages, Rev. 4, 2004.

Smart Site.RTM. Alaris Medical Systems Product Brochure, 4 pages, Issue 1, Oct. 1999.

Smart Site.RTM. Needle-Free Systems, Alaris Medical Systems Webpage, 4 pages, Feb. 2006.

Photographs of Alaris Medical Systems SmartSite.RTM. device, 5 pages, 2002.

Non-Vented Vial Access Pin with ULTRASITE.RTM. Valve, B. Braun Medical, Inc. website and product description, 3 pages, Feb. 2006.

http://www.westpharma.com/en/products/Pages/Mixject.aspx.

http://www.westpharma.com/SiteCollectionDocuments/Recon/mixject%20product%20sheet.pdf; MIXJECT product information sheet pp. 1.

The MixJect transfer system, as shown in the article, "Advanced Delivery Devices," Drug Delivery Technology Jul./Aug. 2007 vol. 7 No. 7 [on-line]. [Retrieved from Internet May 14, 2010.] URL: <http://www.drugdeiverytech-online.com/drugdelivery/200707/?pg=28pg28>. (3 pages).

Publication date of Israeli Patent Application 186290 [on-line]. ]Retrieved from Internet May 24, 2010]. URL:<http://www.Ipatsearch.justrice.gov.il/UI/RequestsList.aspx>. (1 page).

Overview—Silicone Rubber [retrieved from http://www.knovel.com/web/portal/browse/display?_EXT_KNOVEL_DISPLAY_bookid=1023&VerticalID=0 on Feb. 9, 2011].

Kipp, "Plastic Material Data Sheets," retrieved from the internet: http://www.knovel.com/web/portal/browse/display?_EXT_KNOVEL_DISPLAY_bookid=1023&VerticalID=0, retrieved on Feb. 9, 2011.

Alaris Medical Systems Product Brochure, 4 pages, Issue 1, Oct. 11, 1999.

Smart Site Needle-Free Systems, Alaris Medical Systems Webpage, 4 pages, Feb. 2006.

IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).

Drug Administration Systems product information sheets; http://www.westpharma.com/eu/en/products/Pages/Vial2Bag.aspx; pp. 1-3.

Article with picture of West Pharmaceutical Services Vial2Bag Needleless System, [on-line]; ISIPS Newsletter, Oct. 26, 2007]; retrieved from Internet Feb. 16, 2010]; URL:<http://www.isips.org/reports/ISIPS_Newsletter_October_26_2007. html.> (7 pages. see pp. 5-6).

Int'l Search Report and Written Opinion dated May 8, 2014 in Int'l Application No. PCT/IL2013/050706.

U.S. Appl. No. 14/423,595 by Lev, filed Feb. 24, 2015.

Office Action dated Aug. 7, 2015 in JP Application No. 2015-529206.

West, Vial2Bag DC system, Oct. 2, 2014, https://web.archive.org/web/20141002065133/http://www.westpharma.com/en/products/Pages/Reconstitutionsystems.aspx.

Youtube.com, Vial2Bag DC, Aug. 21, 2014, https://www.youtube.com/watch?v=FEOkglxNBrs.

Office Action dated Jun. 26, 2017 in U.S. Appl. No. 14/423,595, by Lev.

(56) References Cited

OTHER PUBLICATIONS

Vial-Mate Adapter Device, Baxter, May 2017, downloaded from web page:http://www.baxtermedicationdeliveryproducts.com/drug-delivery/vialmate.html, Download Date: Jul. 28, 2017, original posting date: unknown, 1page.

LIQUID DRUG TRANSFER DEVICES

CROSS-REFERENCE TO RELATED APPLICATION

This application is a Divisional of U.S. patent application Ser. No. 14/423,595 filed Feb. 24, 2015 which was a Section 371 of International Application No. PCT/IL2013/050706, filed Aug. 20, 2013, which was published in the English language on Mar. 6, 2014, under International Publication No. WO 2014/033706 A3, which claims priority to U.S. Provisional Application No. 61/731,574 filed Nov. 30, 2012, and the disclosure of which is incorporated herein by reference.

FIELD OF THE INVENTION

The invention relates to liquid drug transfer devices.

BACKGROUND OF THE INVENTION

Liquid drug transfer devices including universal drug vial adapters for telescopic mounting on a drug vial of a small drug vial and a large drug vial can be classified into one of two types as follows:

First, a universal drug vial adapter shaped and dimensioned to telescopically clamp equally on a small drug vial and a large drug vial. Exemplary prior art references include inter alia U.S. Pat. No. 5,334,179 to Poli et al, U.S. Pat. No. 6,656,433 to Sasso, U.S. Pat. No. 6,875,205 to Leinsing, and U.S. Pat. No. 8,469,939 to Fangrow.

And second, a universal drug vial adapter shaped and dimensioned to telescopically clamp on a large drug vial only and provided with a vial coupling adapter for insertion thereinto shaped and dimensioned to telescopically clamp on a small drug vial only. U.S. Pat. No. 5,893,397 to Peterson et al discloses a Medication Vial/Syringe Liquid Transfer Apparatus including a liquid transfer apparatus (20) with a liquid drug transfer device (24) and a vial coupling adapter (26).

Some liquid drug transfer devices are intended to be mounted on injection ports of infusion bags containing infusion liquid. Different suppliers of infusion bags provide injection ports of different sizes. U.S. Pat. No. 4,607,671 to Aalto et al. discloses a reconstitution device (10) including a plastic housing (52) for sealed mounting on an injection site (34). The plastic housing (34) includes a rigid tubular double pointed needle (54).

There is a need for liquid drug transfer devices with improved universal drug vial adapters for mixing, reconstitution and administration purposes and improved injection port connectors.

SUMMARY OF THE INVENTION

One aspect of the present invention is directed toward liquid drug transfer devices with universal drug vial adapters for telescopic clamping a drug vial of a so-called small drug vial and a so-called large drug vial. Large drug vials have the same shape as small drug vials but proportionally larger dimensions. In particular, large drug vials have a drug vial closure and a drug vial neck with wider diameters than their counterpart small drug vials. For the purpose of the present description, so-called small drug vials are widely commercially available 13 mm drug vials and so-called large drug vials are widely commercially available 20 mm drug vials. The present invention is equally applicable to larger so-called small drug vials and so-called large drug vials containing larger liquid volumes, for example, a 28 mm diameter drug vial closure and a 32 mm diameter drug vial closure, respectively.

Some preferred embodiments of the liquid drug transfer devices in accordance with the present invention include a universal drug vial adapter employing the same at least one pair of generally opposite upright flex members for clamping a small drug vial and a large drug vial by virtue of the inherent flexibility of the plastic material, for example, polycarbonate, and the like, from which the universal drug vial adapters are manufactured. The at least one pair of flex members are resiliently flexibly mounted on crosspieces towards a drug vial base as opposed to a drug vial head on telescopically clamping a universal drug vial adapter on a drug vial. The flex members have flex member free ends opposite their respective crosspieces which each include an inward radial directed drug vial grip. The inward radial directed drug vial grips underlie a drug vial head on telescopically clamping a universal drug vial adapter on a drug vial. Generally speaking, the flex members are outwardly resiliently flexed correspondingly at their crosspieces with respect to the longitudinal drug vial adapter axis to a greater extent on telescopically clamping the universal drug vial adapter on a large drug vial compared to telescopically mounting the universal drug vial adapter on a small drug vial.

Other preferred embodiments of the liquid drug transfer devices in accordance with the present invention include a universal drug vial adapter employing a set of minor flex members for telescopically clamping a small drug vial and a set of major flex members encircling the set of minor flex members for telescopically clamping a large drug vial whereupon the large drug vial underlies the set of minor flex members. The set of major flex members are preferably arranged such that the set of minor flex members are free to outwardly flex with respect to a longitudinal drug vial adapter axis on being telescopically clamped on a small drug vial without interference from the set of major flex members.

A wide range of liquid drug transfer devices can be formed with the universal drug vial adapters of the present invention for different liquid drug transfer purposes. The universal drug vial adapters can be optionally formed in vented and unvented versions. Some liquid drug transfer devices can include an integral access port and an integral puncturing member for puncturing a drug vial stopper on telescopically clamping a drug vial for enabling flow communication with its interior. Such liquid drug transfer devices include inter alia a female drug vial adapter with a female Luer connector, a male drug vial adapter including a male Luer connector, and the like.

Other liquid drug transfer devices can be so-called ready-to-use medical devices including a pre-attached intact, namely, not punctured, drug vial. Such liquid drug transfer devices can include a discrete liquid transfer member with a puncturing member for puncturing a drug vial on actuation. The universal drug vial adapters of the present invention are preferably designed such that an intact drug vial can be readily released by a drug vial release tool for subsequent use, thereby avoiding possible drug waste. Intact drug vials can be possibly returned to suitable storage conditions without a bulky liquid drug transfer device.

Another aspect of the present invention is directed to liquid drug transfer devices with a universal injection port connector for attachment to a conventional injection port of an infusion bag. Conventional injection ports include an injection port tip with a trailing injection port tip rim disposed behind an exposed plug surface of a self-sealing plug for needle injection of syringe contents into an infusion bag. The universal injection port connectors include a multitude of curved connector members which are outwardly urged from their non-flexed position on forced inward insertion of an injection port tip therethrough such that the multitude of curved connector members snap behind the trailing injection port tip rim, thereby precluding sliding withdrawal of the injection port tip from the universal injection port connector. By virtue of their curved shape, the connector members of the universal injection port connector of the present invention are capable of countering a greater withdrawal force compared to straight connector members. Moreover, the curved connector members facilitate mounting on different sizes of injection ports typically of different suppliers of infusion liquid containers.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF PREFERRED EMBODIMENTS OF THE INVENTION

Figure 1:
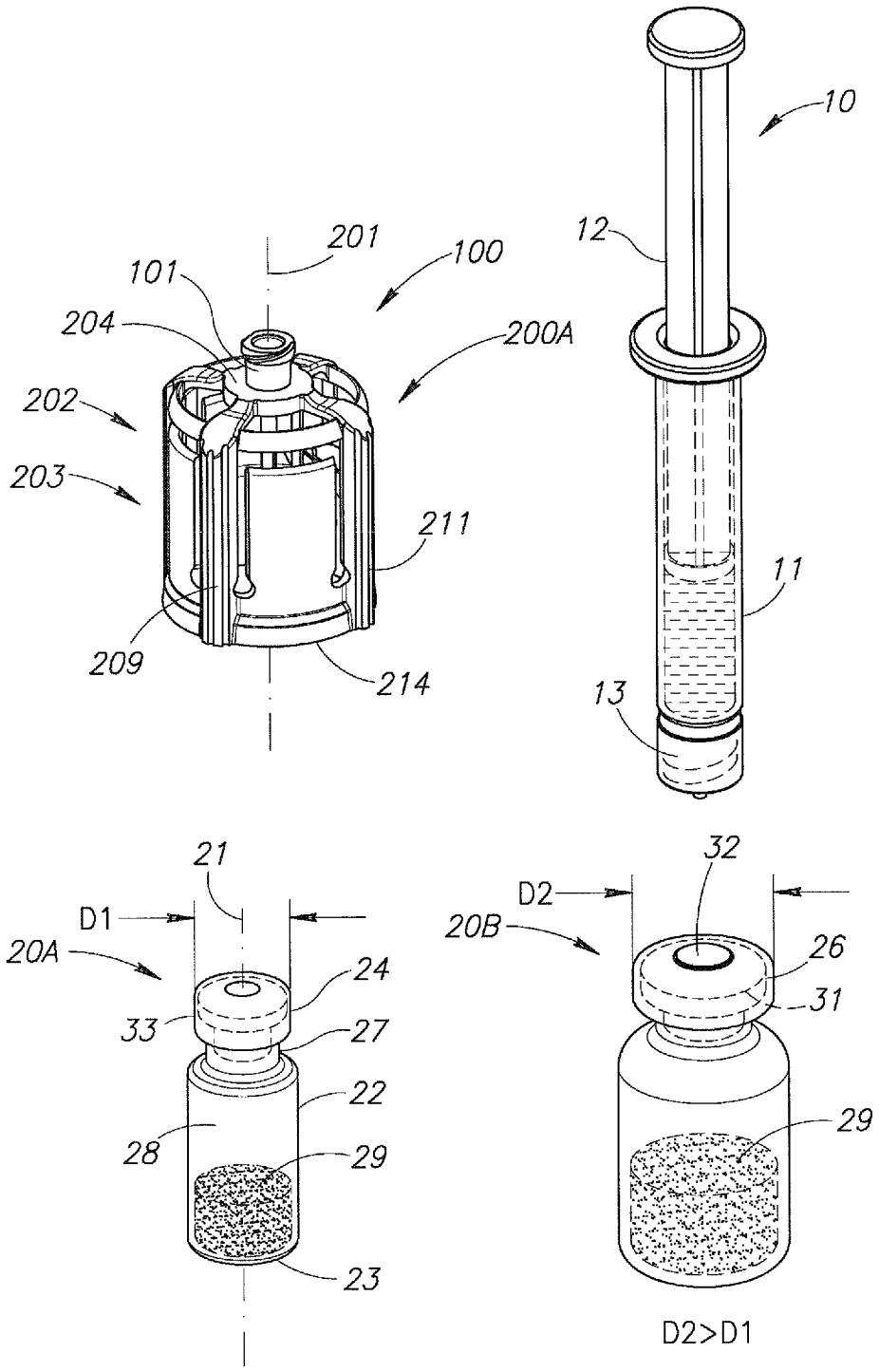
FIG. 1 is a pictorial view of a syringe, a small drug vial, a large drug vial, and a first preferred embodiment of a liquid drug transfer device in accordance with the present invention.
Figure 2:
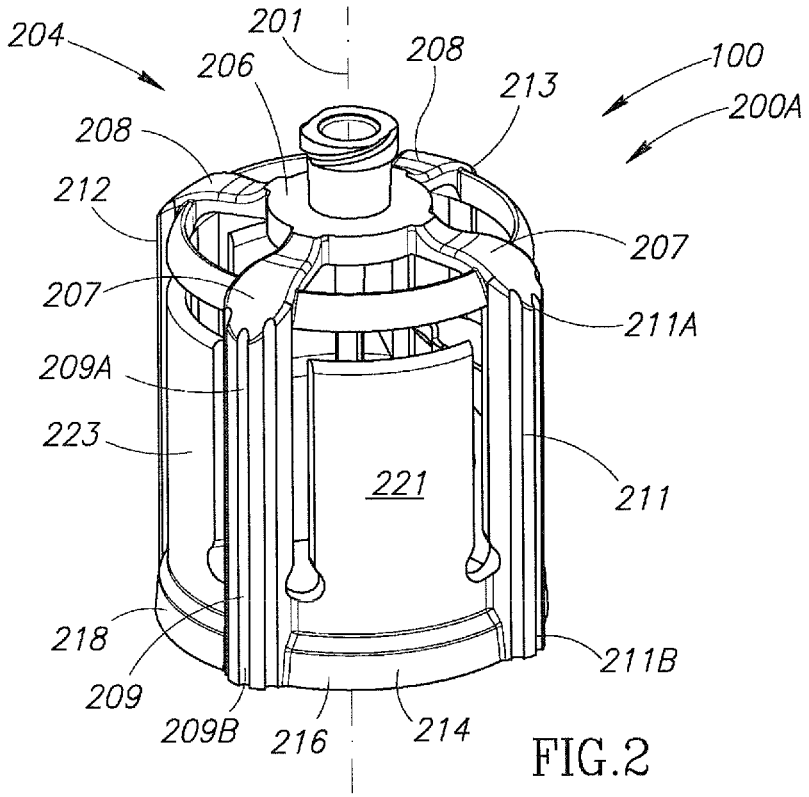
FIG. 2 is a front perspective view of FIG. 1's liquid drug transfer device.
Figure 3:
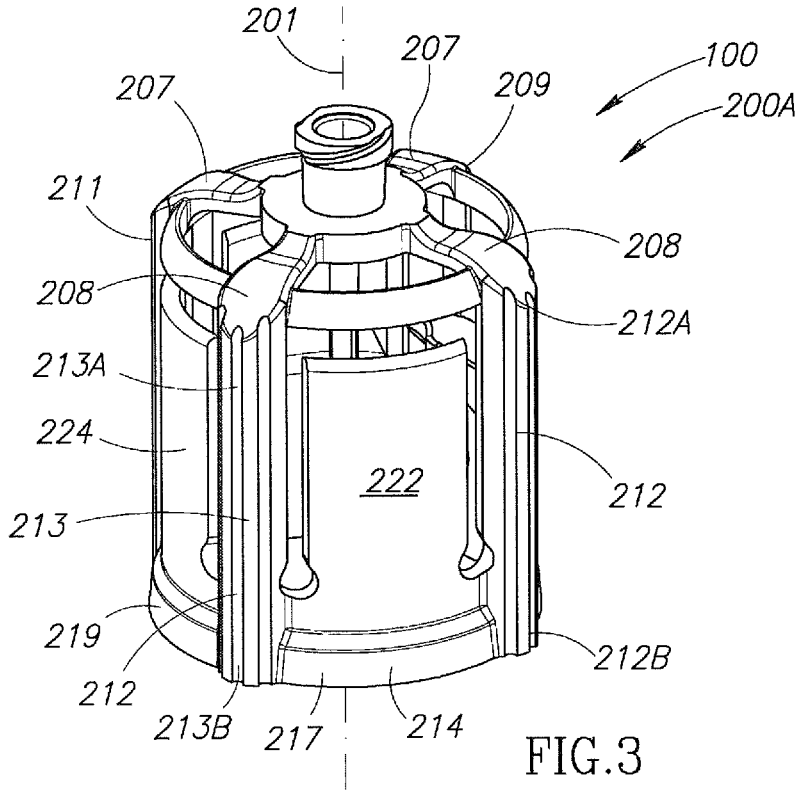
FIG. 3 is a rear perspective view of FIG. 1's liquid drug transfer device.
Figure 4A:
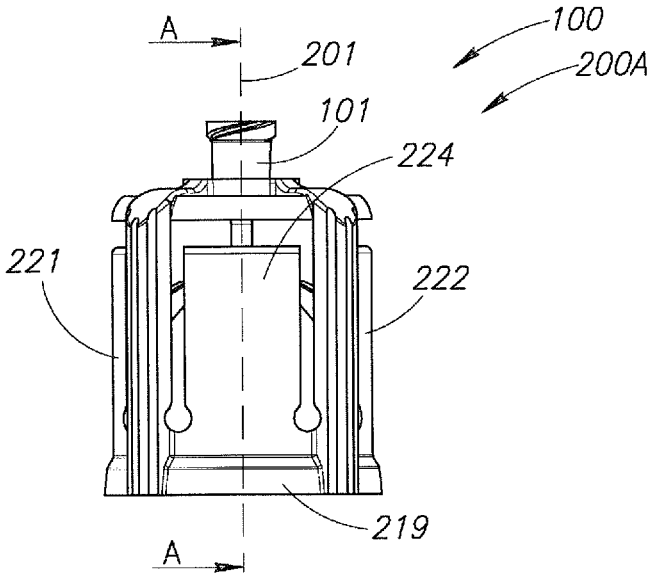
FIG. 4A is a right side elevation view of FIG. 1's liquid drug transfer device.
Figure 4B:
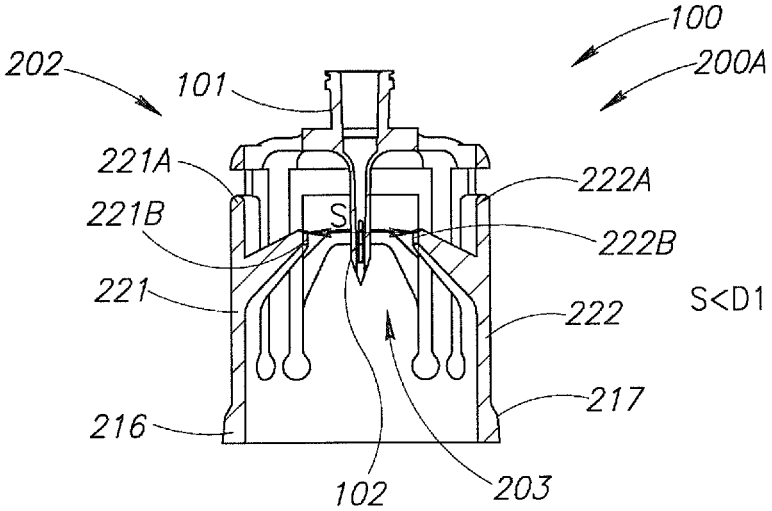
FIG. 4B is a longitudinal cross section of FIG. 1's liquid drug transfer device along line A-A in FIG. 4A.
Figure 5A:
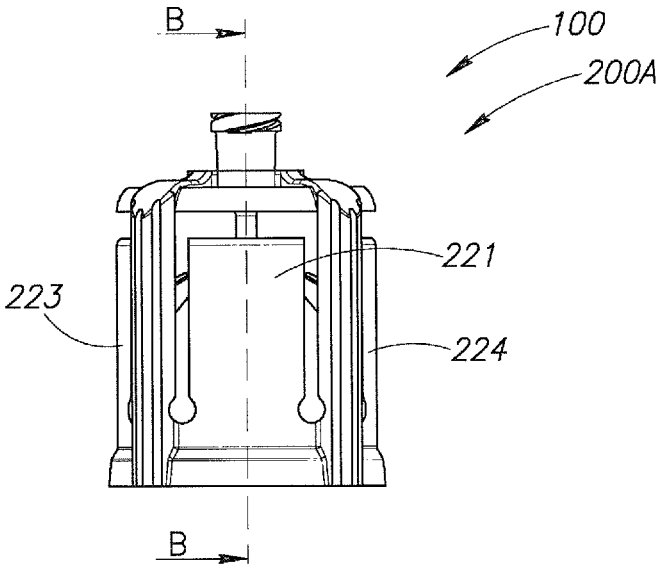
FIG. 5A is a front elevation view of FIG. 1's liquid drug transfer device.
Figure 5B:
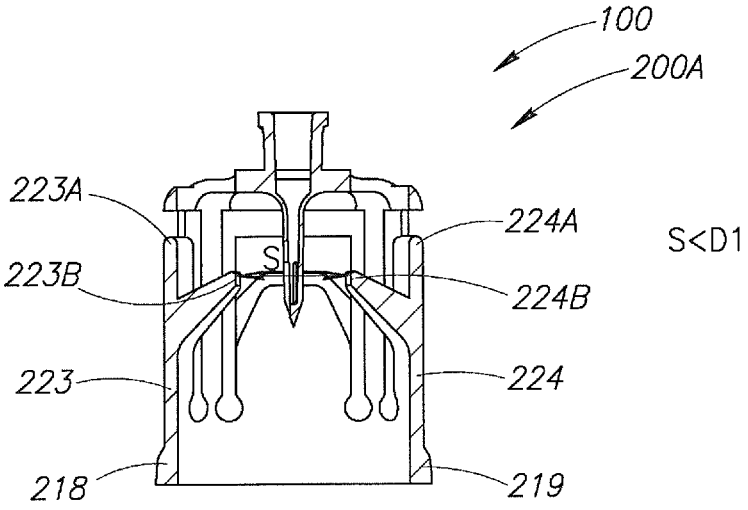
FIG. 5B is a longitudinal cross section of FIG. 1's liquid drug transfer device along line B-B in FIG. 5A.
Figure 6:
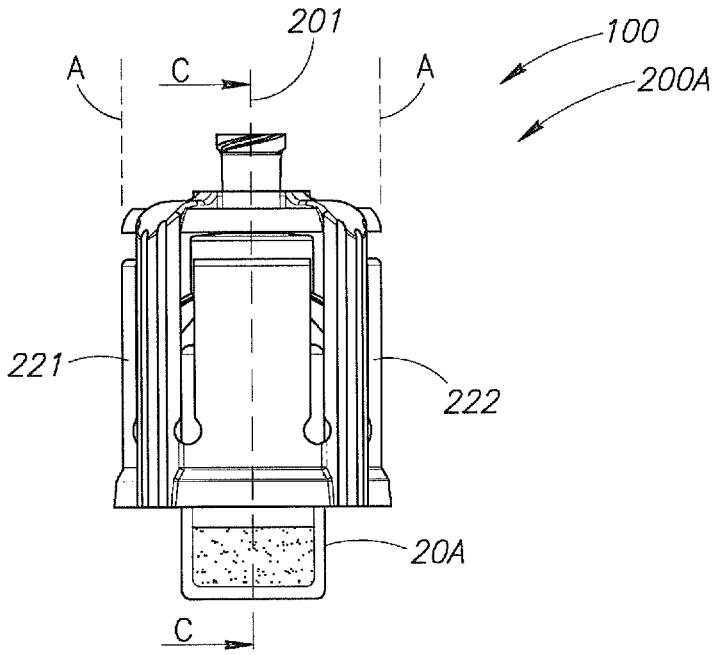
FIG. 6 is a front elevation view of FIG. 1's liquid drug transfer device telescopically clamped on a small drug vial.
Figure 7:
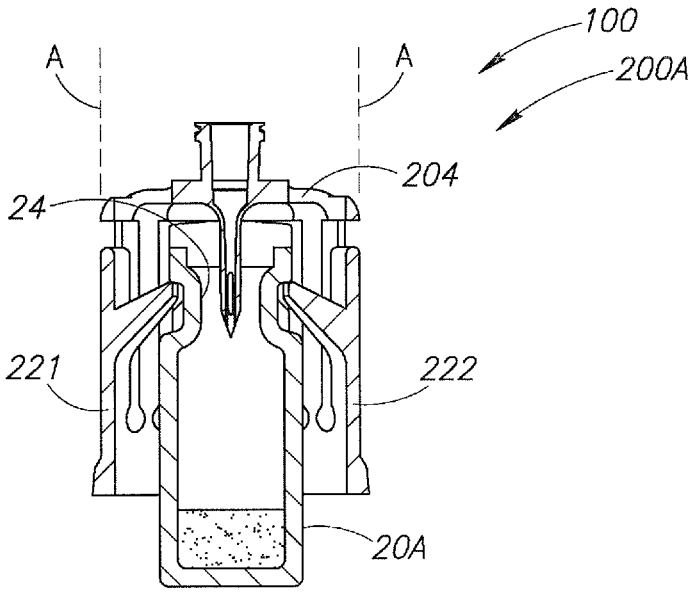
FIG. 7 is a longitudinal cross section of FIG. 6's assemblage along line C-C thereon.
Figure 8:
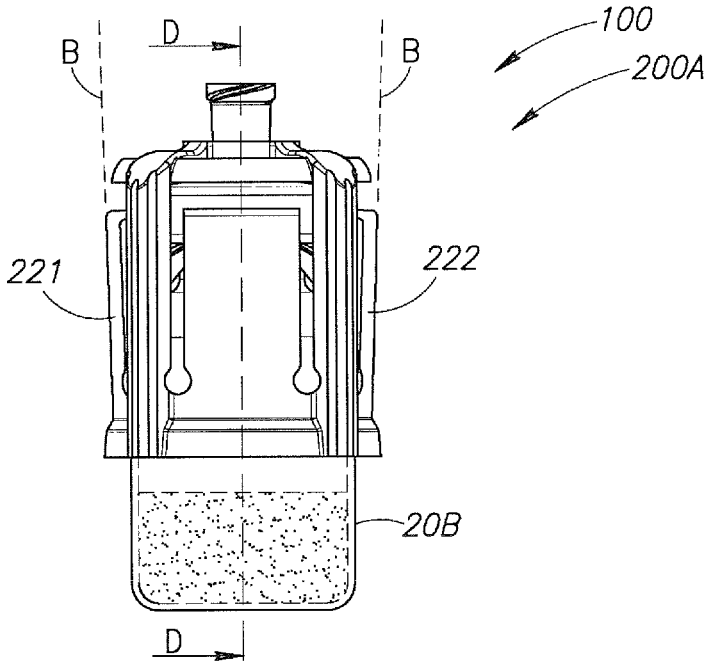
FIG. 8 is a front elevation view of FIG. 1's liquid drug transfer device telescopically clamped on a large drug vial.
Figure 9:
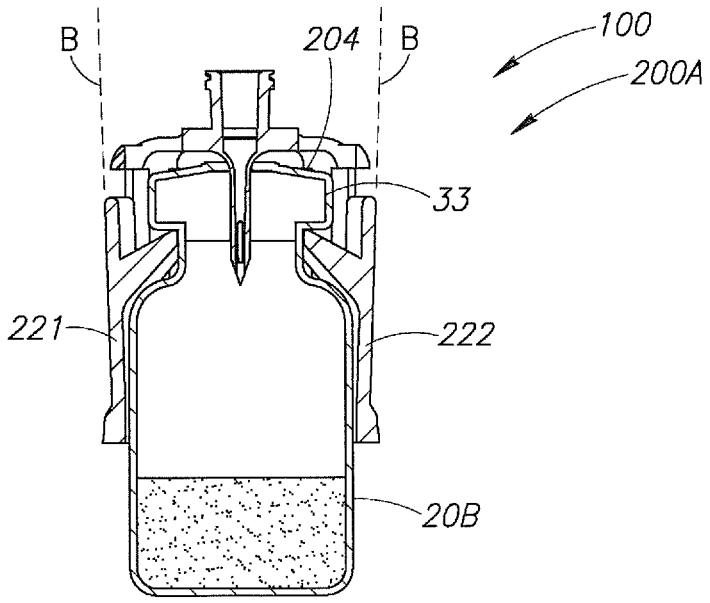
FIG. 9 is a longitudinal cross section of FIG. 8's assemblage along line D-D thereon.

FIG. 1 shows a syringe 10, a small drug vial 20A, a large drug vial 20B, and a liquid drug transfer device 100 constituted as a female vial adapter for use with the syringe 10 and a drug vial 20 of the small drug vial 20A and the large drug vial 20B.

The syringe 10 includes a barrel 11 with a plunger rod 12 and a male Luer lock connector 13. The syringe 10 can be formed with other types of male connectors, for example, a slip Luer connector, and the like. The syringe 10 is typically filled with diluent. Alternatively, the syringe 10 can include an active liquid component.

The drug vials 20 have a longitudinal drug vial axis 21 and include a drug vial body 22 having a drug vial base 23, a drug vial head 24 defining a drug vial opening 26, and a narrow diameter drug vial neck 27 between the drug vial body 22 and the drug vial head 24. The drug vials 20 have a drug vial interior 28 for storing a powder or liquid medicament 29. The drug vials 20 are sealed by a drug vial stopper 31 inserted into the drug vial opening 26. The drug vial stopper 31 has an uppermost drug vial surface 32. The drug vials 20 are hermetically sealed by a drug vial closure 33 constituted, for example, by an aluminum band, and the like.

Widely commercially available small drug vials 20A have a drug vial closure 33 with an external diameter D1 of between 13 mm and 14 mm and widely commercially available large drug vials 20B have a drug vial closure 33 with an external diameter D2>D1 and typically between 20 mm and 21 mm.

FIGS. 1 to 11 show the liquid drug transfer device 100 includes a universal drug vial adapter 200A and a female Luer connector 101 for engagement with the syringe's male Luer lock connector 13. The liquid drug transfer device 100 includes a tubular puncturing member 102 in flow communication with the female Luer connector 101 for enabling flow access to a drug vial interior 28.

The universal drug vial adapter 200A has a longitudinal drug vial adapter axis 201 and a skirt 202 for defining a drug vial cavity 203 for snugly telescopically receiving at least a top part of the drug vial 20B therein and therefore inherently a top part of the drug vial 20A. The skirt 202 includes a top wall 204 constituted by an annular centerpiece 206 with a first pair of two radial directed struts 207 and a second pair of two radial directed struts 208. The annular centerpiece 206 is formed with the upright female Luer connector 101.

The skirt 202 includes a first pair of axial directed spaced apart flex member supports 209 and 211 downward depending from the radial directed struts 207. The skirt 202 includes a second pair of axial directed spaced apart flex member supports 212 and 213 downward depending from the radial directed struts 208. The first pair of axial directed flex member supports 209 and 211 are opposite the second pair of axial directed flex member supports 212 and 213.

The flex member support 209 has a proximate end 209A adjacent the top wall 204 and a distal end 209B remote therefrom. The flex member support 211 has a proximate end 211A adjacent the top wall 204 and a distal end 211B remote therefrom. The flex member support 212 has a proximate end 212A adjacent the top wall 204 and a distal end 212B remote therefrom. The flex member support 213 has a proximate end 213A adjacent the top wall 204 and a distal end 213B remote therefrom.

The skirt 202 includes a single continuous annular support 214 including a first crosspiece 216 extending between the distal ends 209B and 211B, a second crosspiece 217 extending between the distal ends 212B and 213B, a third crosspiece 218 extending between the distal ends 209B and 212B and a fourth crosspiece 219 extending between the distal ends 211B and 213B.

The skirt 202 includes an axial directed first flex member 221 resiliently flexibly mounted on the first crosspiece 216, an axial directed second flex member 222 resiliently flexibly mounted on the second crosspiece 217 and opposite the first flex member 221, an axial directed third flex member 223 resiliently flexibly mounted on the third crosspiece 218 between the first flex member 221 and the second flex member 222, and an axial directed fourth flex member 224 resiliently flexibly mounted on the fourth crosspiece 219 and opposite the third flex member 223.

The first flex member 221 has a first flex member free end 221A remote from the first crosspiece 216 and an inward radial directed first drug vial grip 221B theretoward. The second flex member 222 has a second flex member free end 222A remote from the second crosspiece 217 and an inward radial directed second drug vial grip 222B theretoward. The third flex member 223 has a third flex member free end 223A remote from the third crosspiece 218 and an inward radial directed third drug vial grip 223B theretoward. The fourth flex member 224 has a fourth flex member free end 224A remote from the fourth crosspiece 219 and an inward radial directed fourth drug vial grip 224B theretoward.

The first drug vial grip 221B and the second drug vial grip 222B define a separation S therebetween where S<D1 and similarly the third drug vial grip 223B and the fourth drug vial grip 224B define the separation S therebetween such that they underlie a drug vial closure 33 of a drug vial 20A on telescopically clamping the liquid drug transfer device 100 thereon. Since D2>D1, the drug vial grips 221B, 222B, 223B and 224B also underlie a drug vial closure 33 of a drug vial 20B.

The flex members 221, 222, 223 and 224 are generally parallel to the longitudinal drug vial adapter axis 201 before telescopically clamping the liquid drug transfer device 100 on a drug vial 20A. On telescopically clamping the liquid drug transfer device 100 on a drug vial 20A, the flex members 221, 222, 223 and 224 are outwardly resiliently flexed at their respective crosspieces 216, 217, 218 and 219 with respect to the longitudinal drug vial adapter axis 201 as the drug vial closure 33 passes from beneath the drug vial grips 221B, 222B, 223B and 224B to thereabove under the top wall 204 whereupon the flex members 221, 222, 223 and 224 revert to being generally parallel to the longitudinal drug vial adapter axis 201 as depicted by dashed lines A in FIGS. 6 and 7.

In the case of telescopically clamping the liquid drug transfer device 100 on a drug vial 20B, the flex members 221, 222, 223 and 224 are further outwardly resiliently flexed at their respective crosspieces 216, 217, 218 and 219 with respect to the longitudinal drug vial adapter axis 201 relative to the drug vial 20A due to the former 20B have a wide diameter drug vial closure 33 than the latter 20A. In the case of the drug vial 20B, the flex members 221, 222, 223 and 224 are prevented from fully reverting to being generally parallel to the longitudinal drug vial adapter axis 201 but rather remain outwardly flexed with respect to their original unflexed position as depicted by dashed lines B in FIGS. 8 and 9.

Figure 10:
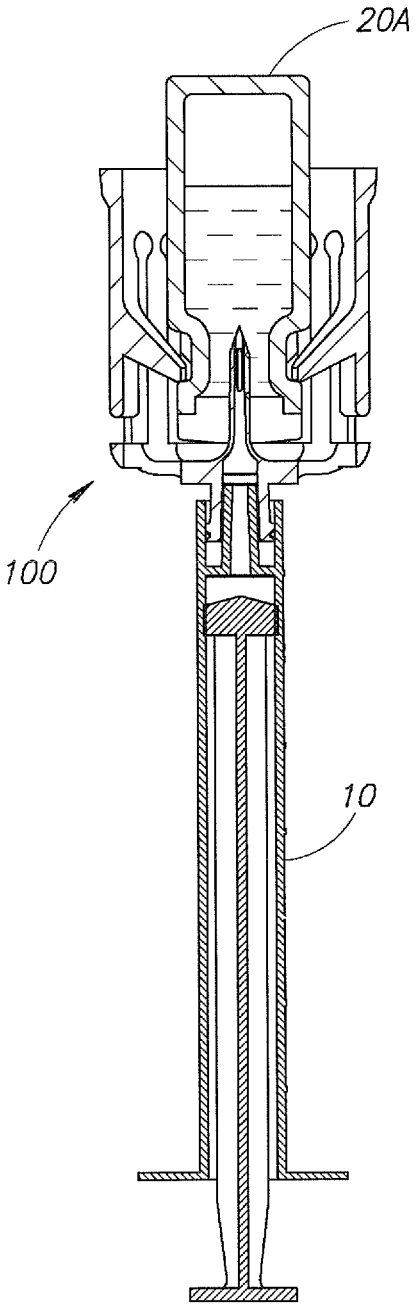
FIG. 10 is a pictorial view showing syringe aspiration of liquid contents from FIG. 6's assemblage.

FIG. 10 shows a syringe 10 attached to the liquid drug transfer device 100 mounted on a drug vial 20A for mixing, reconstitution and aspiration purposes.

Figure 11:
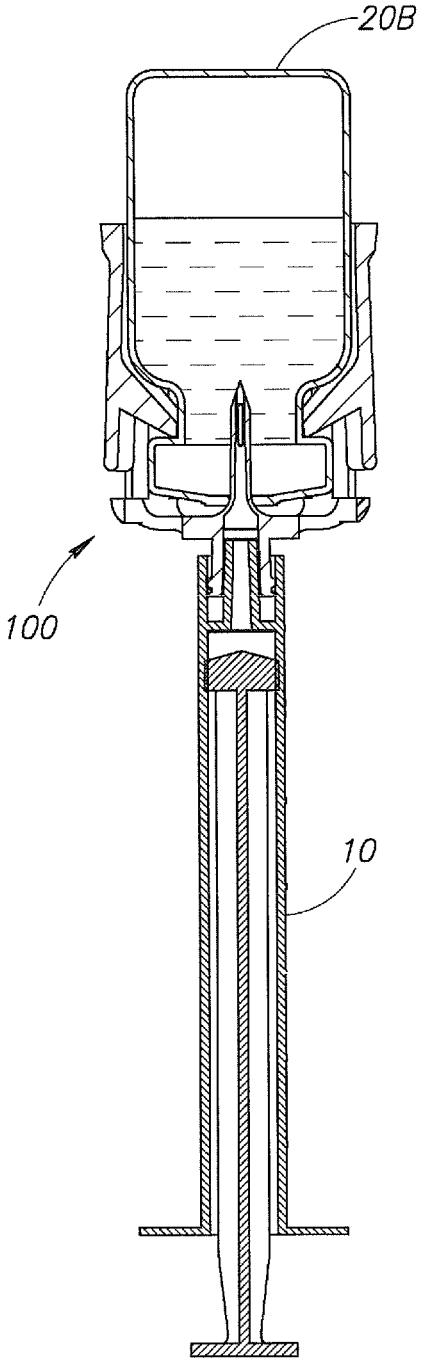
FIG. 11 is a pictorial view showing syringe aspiration of liquid contents from FIG. 8's assemblage.

FIG. 11 shows a syringe 10 attached to the liquid drug transfer device 100 mounted on a drug vial 20B for mixing, reconstitution and aspiration purposes.

Figure 12:
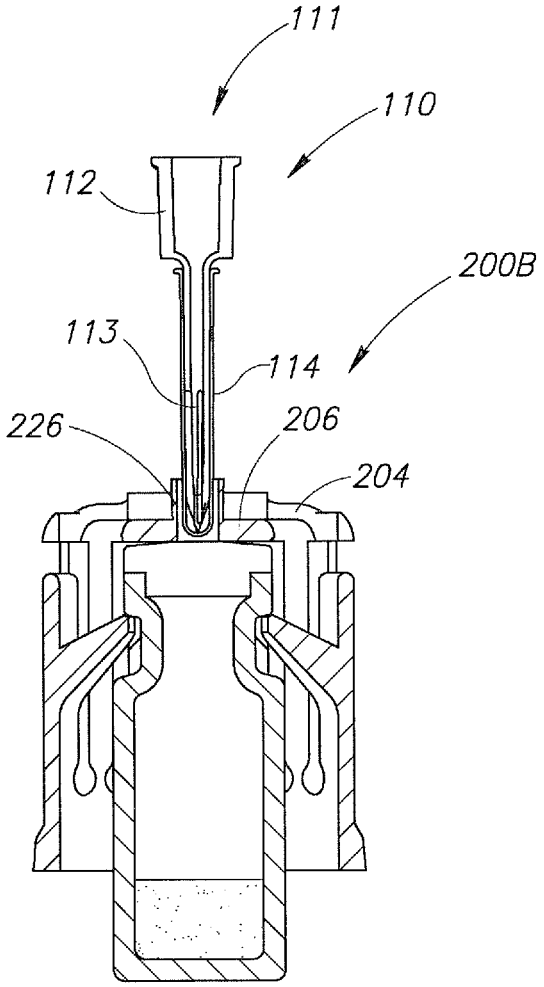
FIG. 12 is a longitudinal cross section of a second preferred embodiment of a liquid drug transfer device in accordance with the present invention.
Figure 13:
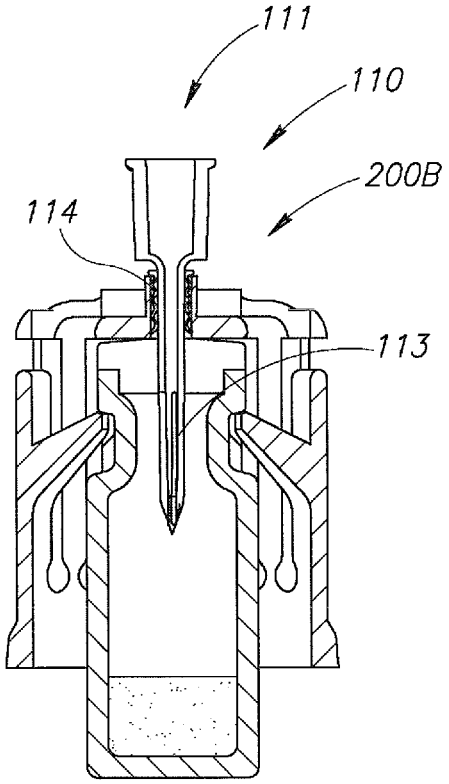
FIG. 13 is a longitudinal cross section of FIG. 12's liquid drug transfer device in a flow communication position.

FIGS. 12 and 13 show a liquid drug transfer device 110 including a universal drug vial adapter 200B and intended for use with a discrete dual ended liquid transfer member 111 formed with a female Luer connector 112 and a puncturing cannula 113 in flow communication therewith. The liquid drug transfer device 110 is similar in construction to the liquid drug transfer device 100 and differs therefrom insofar as its universal drug vial adapter 200B has a top wall 204 formed with the annular centerpiece 206 and a retainer arrangement 226 for retaining the liquid transfer member 111 above the annular centerpiece 206 ready for actuation. The puncturing cannula 113 is covered by a sheath 114 which maintains sterile conditions during storage and for use as a sealing member for use with a drug vial 20. The liquid drug transfer device 110 can be telescopically mounted on a drug vial 20 ready for subsequent actuation by downward depression of the liquid transfer member 111.

Figure 14:
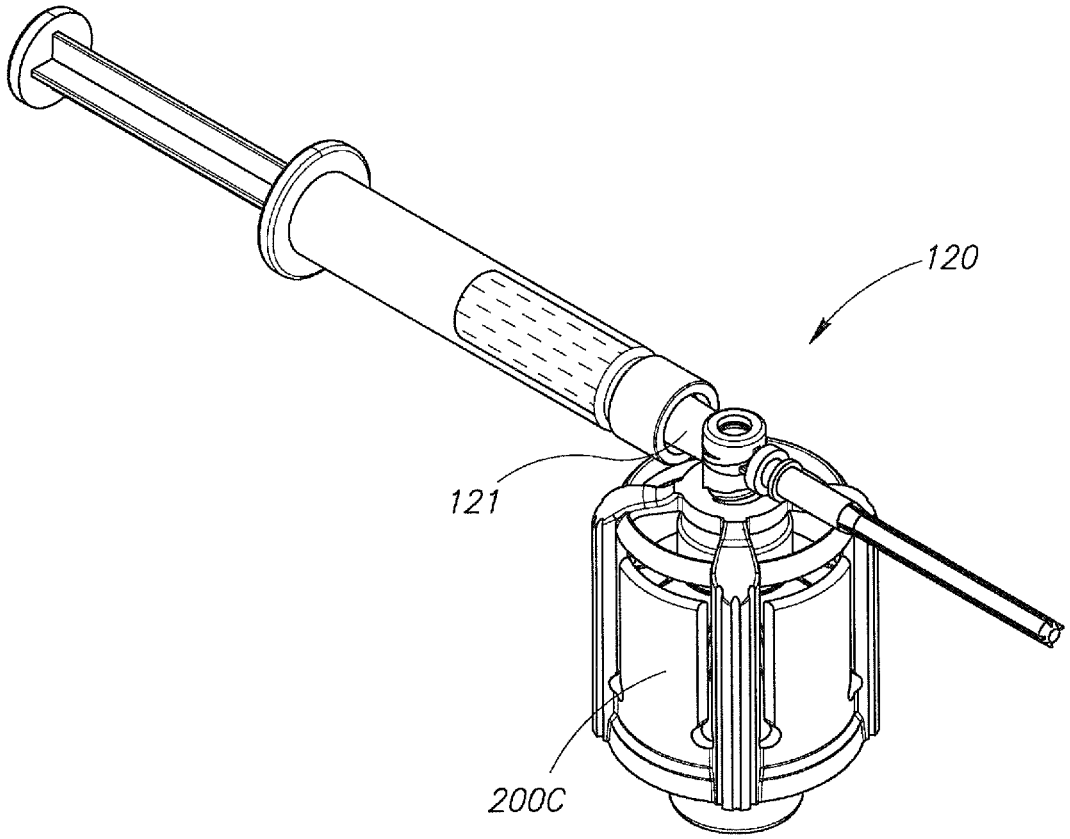
FIG. 14 is a pictorial view of a third preferred embodiment of a liquid drug transfer device in accordance with the present invention.

FIG. 14 shows a liquid drug transfer device 120 as disclosed in commonly owned U.S. Pat. No. 6,238,372 to Zinger et al. including a fluid control device 121 and a universal drug vial adapter 200C for screw thread engagement thereon.

Figure 15:
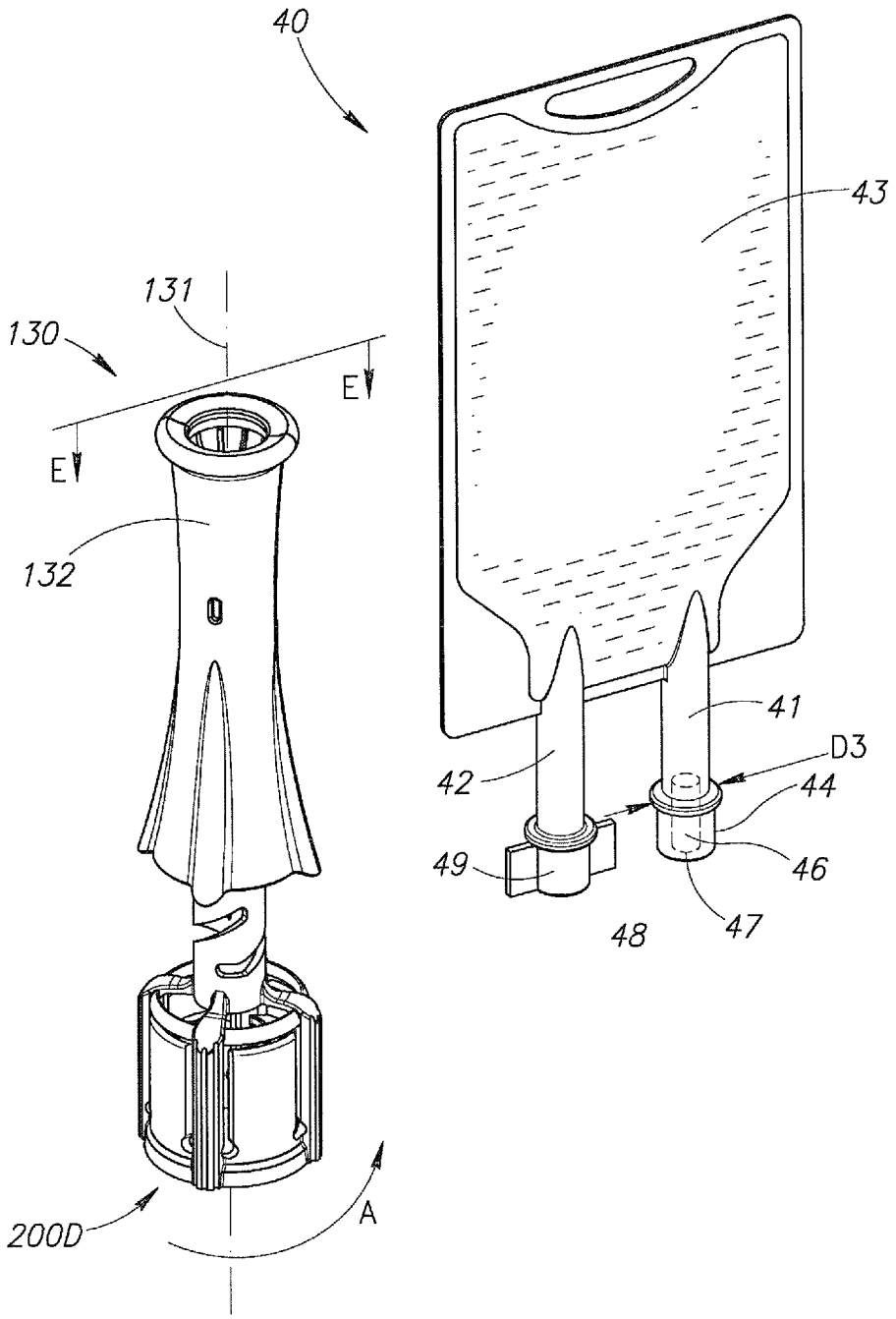
FIG. 15 is a pictorial view of a fourth preferred embodiment of a liquid drug transfer device in accordance with the present invention and an infusion liquid container.
Figure 16:
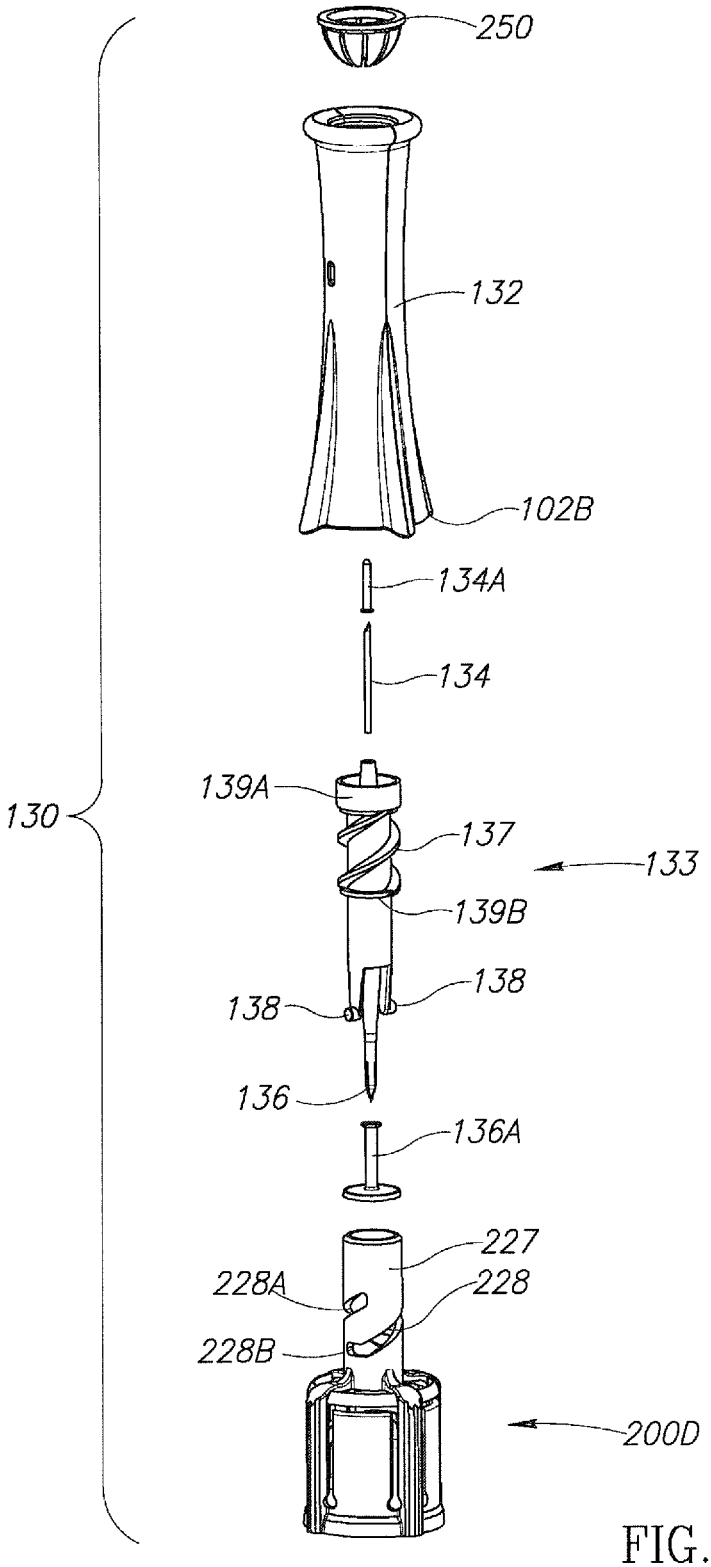
FIG. 16 is an exploded view of FIG. 15's liquid drug transfer device.

FIGS. 15 to 17 show a liquid drug transfer device 130 for use with an infusion liquid container 40 exemplary shown as an IV bag. The IV bag 40 includes an injection port 41, an administration port 42 and liquid contents 43. The IV bag ports 41 and 42 are in the form of plastic tubing. The injection port 41 terminates in an injection port tip 44 containing a self-sealing plug 46 with an exposed plug surface 47 intended for needle injection of syringe contents into the IV bag 40. The injection port tip 44 has a trailing injection port tip rim 48. The administration port 42 is typically sealed by a twist off cap 49 for insertion of an IV spike for administration purposes.

The liquid drug transfer device 130 has a longitudinal liquid drug transfer device axis 131 and includes an injection port adapter 132, a dual ended liquid transfer member 133 and a universal drug vial adapter 200D. The injection port adapter 132 is preferably provided with a universal injection port connector 250 for attachment on the injection port 41. The liquid transfer member 133 is provided with a needle 134 for puncturing the injection port 41 and terminates in a puncturing tip 136 for puncturing a drug vial stopper 31. The needle 134 is protected by a sheath 134A and the puncturing tip 136 is protected by a sheath 136A.

The liquid transfer member 133 is formed with a leading drill like bit 137 and a trailing pair of outward directed pins 138. The universal drug vial adapter 200D differs from the universal drug vial adapter 200A insofar that it has a top wall 204 formed with an axial directed tubular stem 227 on the annular centerpiece 206. The stem 227 has a pair of opposite generally helical tracks 228 for corresponding engagement by the pair of outward radial pins 138. The tracks 228 each have a start track end 228A remote from the top wall 204 and a final track end 228B adjacent the top wall 204.

The drill like bit 137 has a leading stopper 139A and a trailing stopper 139B. The injection port adapter 132 has an internal surface 141 formed with an inward radial directed leading flange 142A and an inward directed trailing flange 142B.

Figures 17A, 17B, 17C:
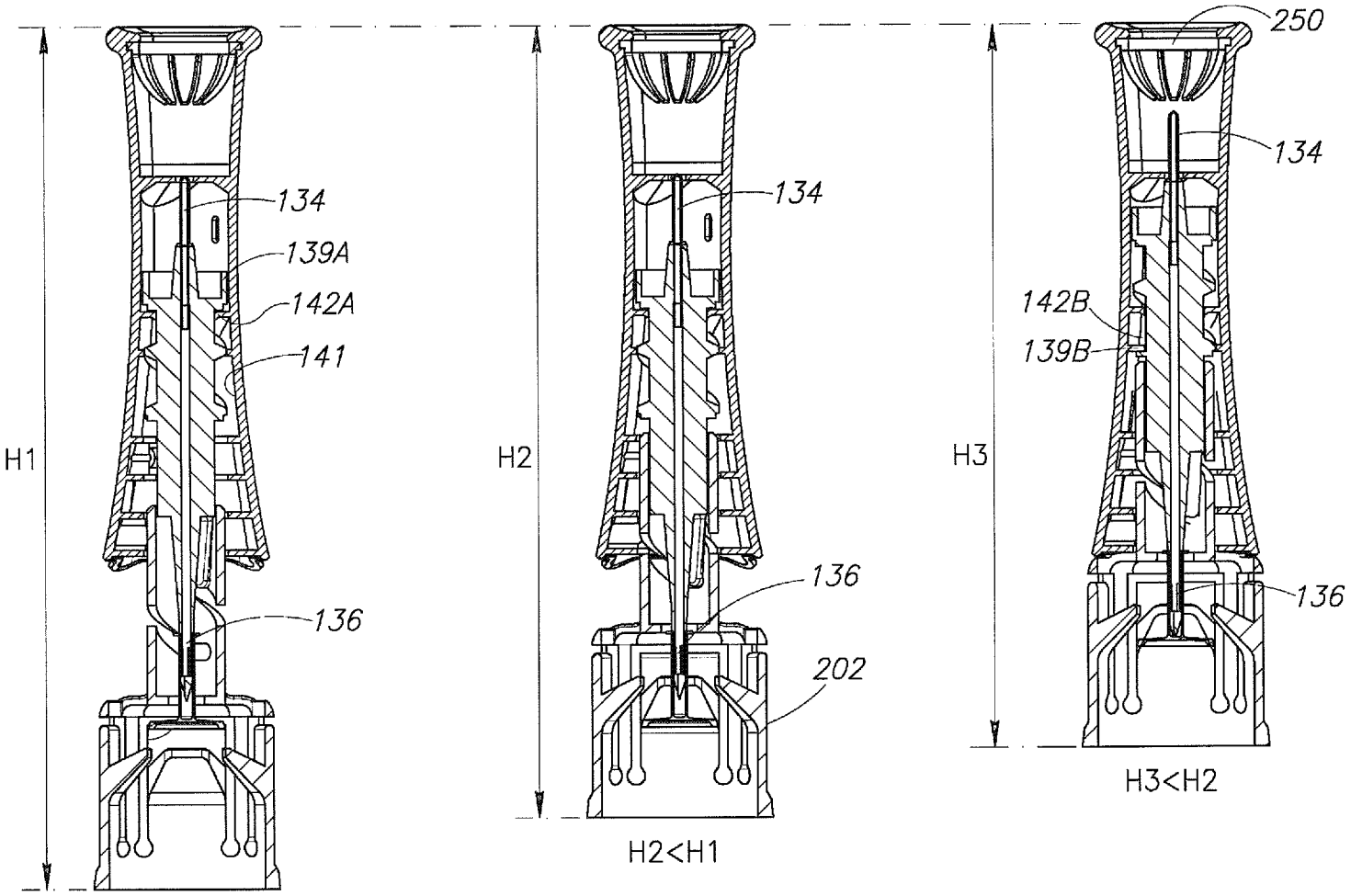
FIG. 17A is a longitudinal cross section of FIG. 15's liquid drug transfer device in an initial pre-actuated position along line E-E in FIG. 15.
FIG. 17B is a longitudinal cross section of FIG. 15's liquid drug transfer device in an intermediate position for puncturing a drug vial along line E-E in FIG. 15.
FIG. 17C is a longitudinal cross section of FIG. 15's liquid drug transfer device in an actuated position for puncturing an infusion liquid container along line E-E in FIG. 15.
Figure 18A:
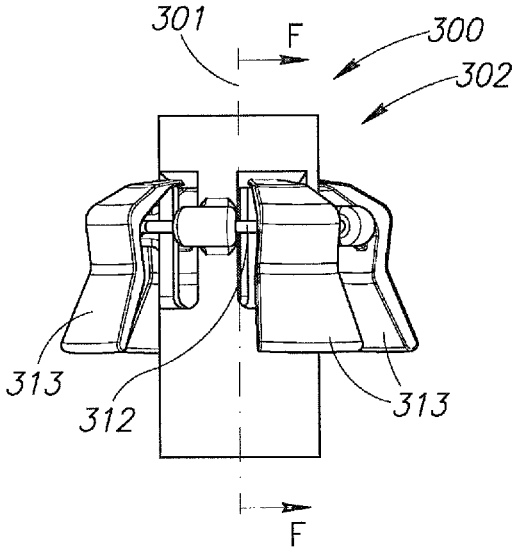
FIG. 18A is a front elevation view of a drug vial release tool in its set-up position.
Figure 18B:
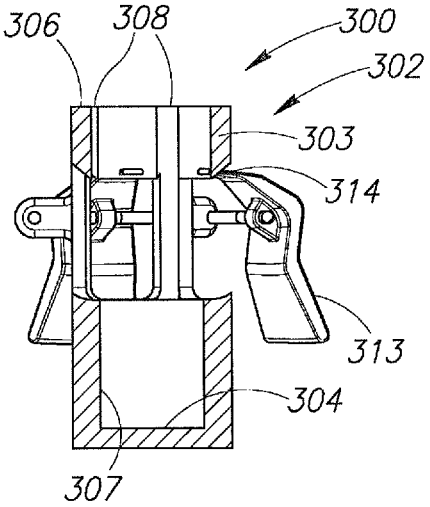
FIG. 18B is a longitudinal cross section of FIG. 18A's drug vial release tool along line F-F thereon.
Figure 19A:
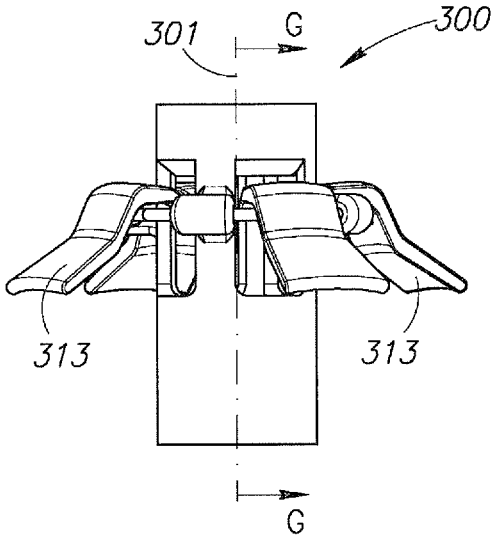
FIG. 19A is a front elevation view of the drug vial release tool in its operative vial release position to release a drug vial.
Figure 19B:
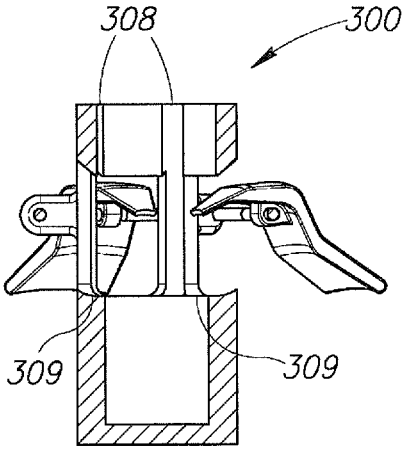
FIG. 19B is a longitudinal cross section of FIG. 19A's drug vial release tool along line G-G thereon.
Figure 20B:
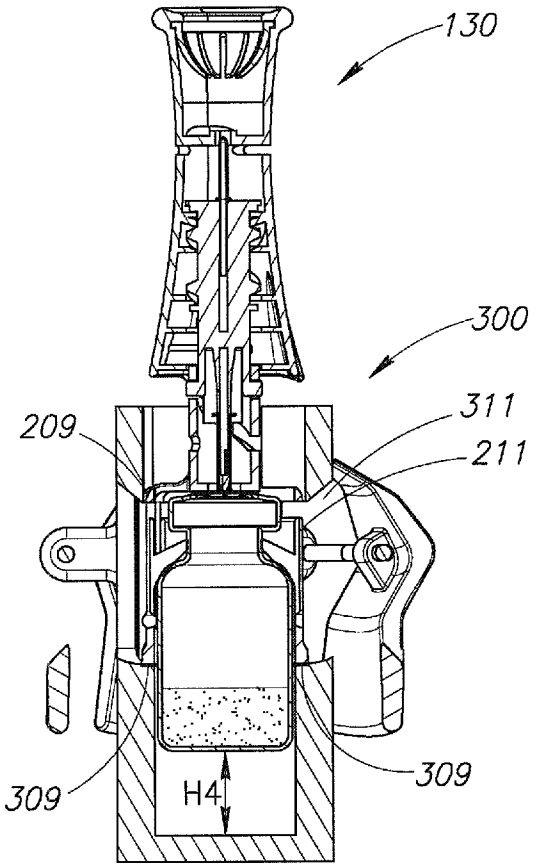
FIG. 20B is a longitudinal cross section of FIG. 20A's assemblage along line H-H thereon.
Figure 20A:
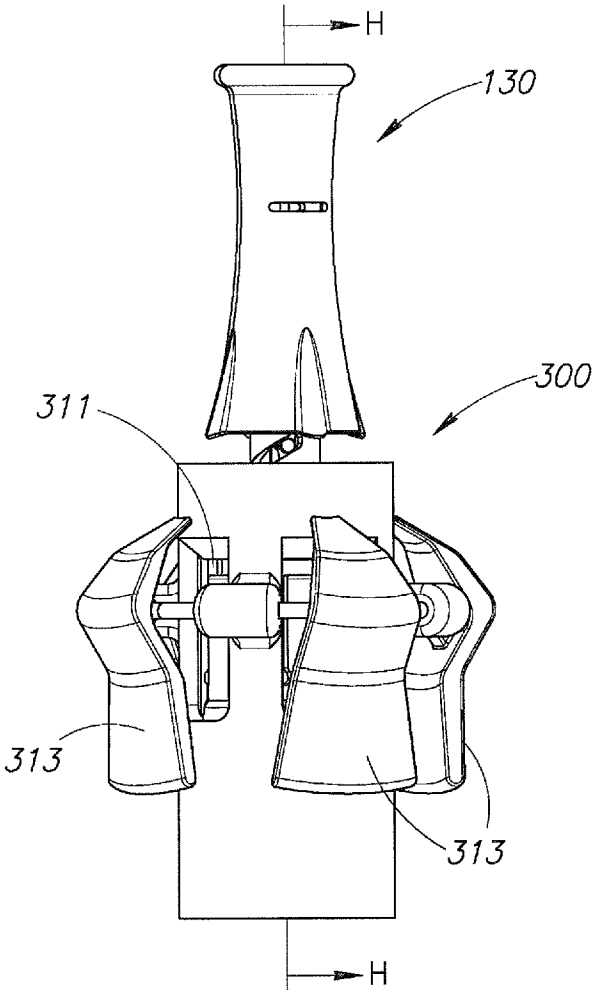
FIG. 20A is a front elevation view of the drug vial release tool in its set-up position mounted on FIG. 15's liquid drug transfer device with a pre-attached intact drug vial.
Figure 21B:
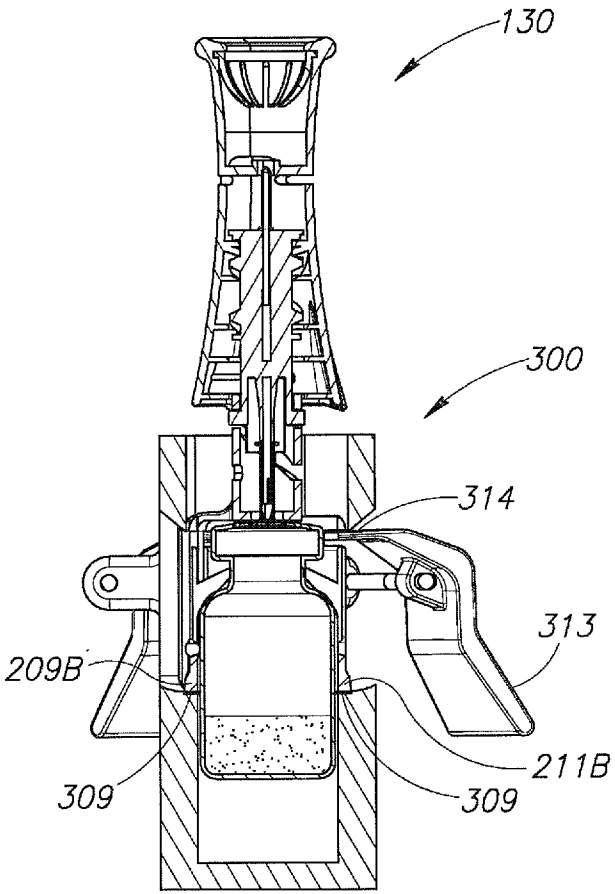
FIG. 21B is a longitudinal cross section of FIG. 21A's assemblage along line I-I thereon.
Figure 21A:
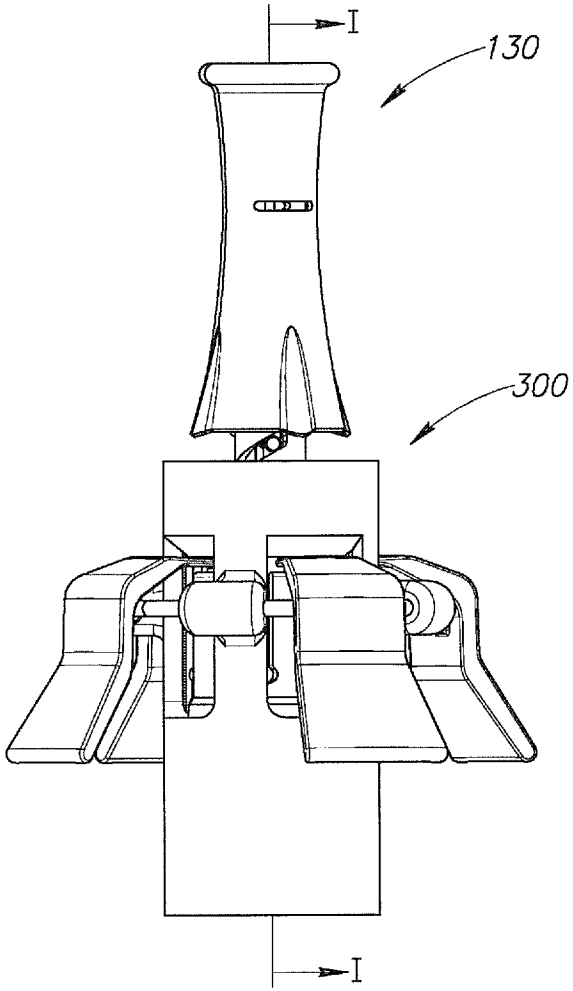
FIG. 21A is a front elevation view of the drug vial release tool in its operative vial release position mounted on FIG. 15's liquid drug transfer device with a pre-attached intact drug vial.
Figure 22B:
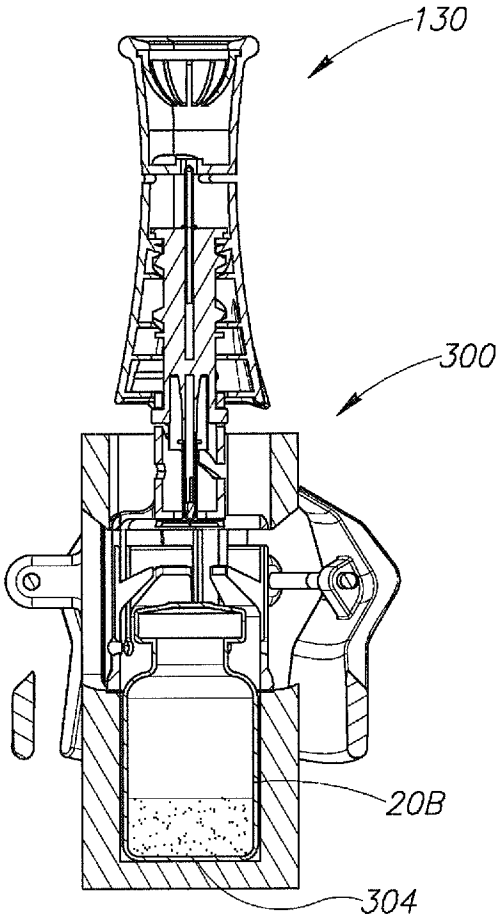
FIG. 22B is a longitudinal cross section of FIG. 22A's assemblage along line J-J thereon.
Figure 22A:
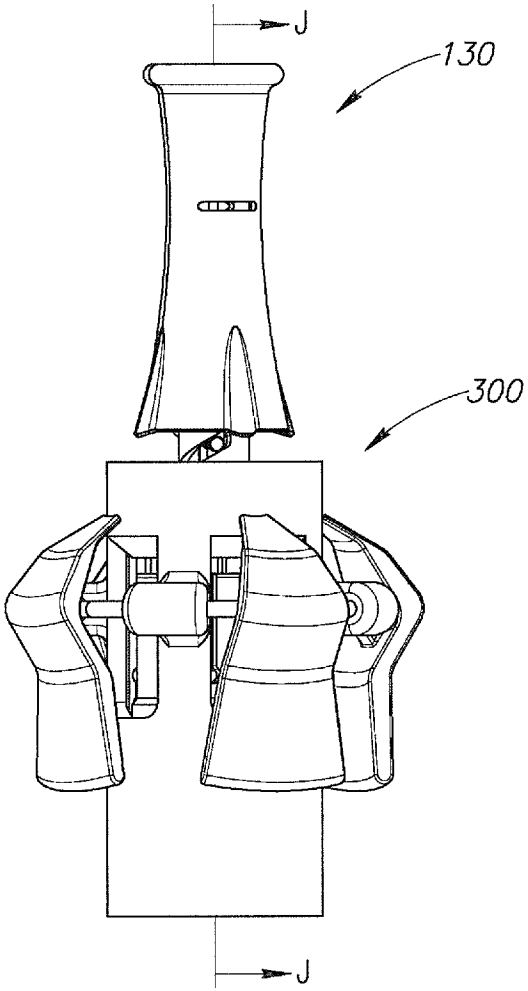
FIG. 22A is a front elevation view of the drug vial release tool mounted on FIG. 15's liquid drug transfer device and a detached intact drug vial.

FIG. 17A shows the leading stopper 139A is disposed on the leading flange 142A in an initial pre-actuated position of the liquid drug transfer device 130. The puncturing tip 136 is deployed above or at the top wall 204 such that an intact drug vial 20 can be telescopically clamped in the universal drug vial adapter 200D for subsequent use. On telescopic mounting a drug vial in the universal drug vial adapter 200D, the puncturing tip 136 is spaced apart from its uppermost drug vial surface 32. The liquid drug transfer device 130 has a height H1 in its initial pre-actuated position.

FIG. 17B shows initial manual actuation rotation of the universal drug vial adapter 200D in a clockwise tightening direction around the longitudinal axis 131 as depicted by arrow A in FIG. 15 leads to the universal drug vial adapter 200D traveling along the liquid transfer member 133 until the outward directed pins 138 stop at the final track ends 228B. This linear movement causes the puncturing tip 136 to puncture through a drug vial stopper 31 into a drug vial interior 28 of a previously clamped drug vial 20 for establishing flow communication with its drug vial interior 28. The liquid drug transfer device 130 has a height H2 in its intermediate drug vial puncturing position where H2<H1.

FIG. 17C shows continuing manual actuation rotation of the universal drug vial adapter 200D in the same clockwise tightening direction leads to the combined movement of the liquid transfer member 133 and the universal drug vial adapter 200D until the trailing stop 141B stops against the trailing flange 142. This linear movement urges the needle 134 towards the universal injection port connector 250 for puncturing an injection port 41, thereby establishing flow communication between an infusion liquid container 40 and a drug vial 20. The liquid drug transfer device 130 has a height H3 in its actuated infusion liquid container puncturing position where H3<H2.

The liquid drug transfer device 130 is preferably provided with a pre-attached intact drug vial 20. The liquid drug transfer device 130 can optionally be pre-attached to an infusion liquid container 40. Accordingly, a user is required to execute a single manual actuation rotation for establishing flow communication between an infusion liquid container and a drug vial.

FIGS. 18 to 23 show a drug vial release tool 300 for releasing an intact drug vial 20 from the liquid drug transfer device 130 in its initial set-up state before having undergone a manual actuation rotation. The construction and operation of the drug vial release tool 300 is shown with reference to a drug vial 20B and equally applies to a drug vial 20A.

The drug vial release tool 300 has a longitudinal tool axis 301 and includes an open-topped housing 302 having a peripheral wall 303, a bottom wall 304 and a top rim 306. The housing 302 is intended to slidingly receive the universal drug vial adapter 200D with a pre-attached intact drug vial 20. The peripheral wall 303 has an internal surface 307 having with four longitudinal directed slots 308 for slidingly receiving the four equispaced downward depending flex member supports 209, 211, 212 and 213 for ensuring correct rotational alignment of the universal drug vial adapter 200D in the drug vial release tool 300. The longitudinal directed slots 308 are each formed with a stopper 309 for stopping the sliding insertion of the universal drug vial adapter 200D into the drug vial release tool 300 such that an intact drug vial 20 is at a height H4 above the inside bottom wall 304 (see FIG. 20B). In the case of manual actuation rotation of the liquid drug transfer device 130, the universal drug vial adapter 132 prevents full insertion of the universal liquid drug adapter 200D into the drug vial release tool 300 as shown in FIGS. 23A and 23B in which the punctured drug vial is at a height H5 above the bottom wall 304.

The housing 302 is formed with four longitudinal directed rectangular apertures 311 in registration with the four resiliently flexible upward depending flex members 221, 222, 223 and 224 on sliding insertion of the universal drug vial adapter 200D thereinto. The drug vial release tool 300 includes an annular railing 312 encircling the housing 302. The railing 312 supports four pivotal release members 313 each having a release member rim 314. The release members 313 have a set-up position enabling free sliding insertion of the universal drug vial adapter 200D into the housing 302 (see FIGS. 20A and 20B). The release members 313 are operable to an operative position such that their release member rims 314 are disposed in the separations between the top wall 204 and the flexible flex members 221, 222, 223 and 224 (see FIGS. 21A and 21B). The release members 313 are manually operated to outwardly flex the flex members 221, 222, 223 and 234 with respect to the longitudinal tool axis 301 thereby freeing the drug vial 20 which drops onto the bottom wall 304 (see FIGS. 22A and 22B).

Figure 23A:
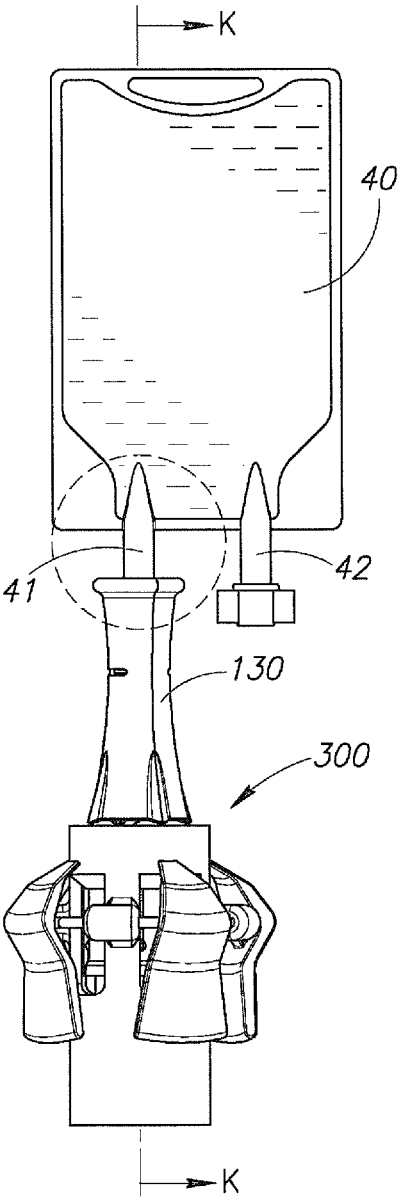
FIG. 23A is a front elevation view of the drug vial release tool in an inoperative position mounted on FIG. 15's liquid drug transfer device with a punctured drug vial after a partial manual actuation rotation.
Figure 23B:
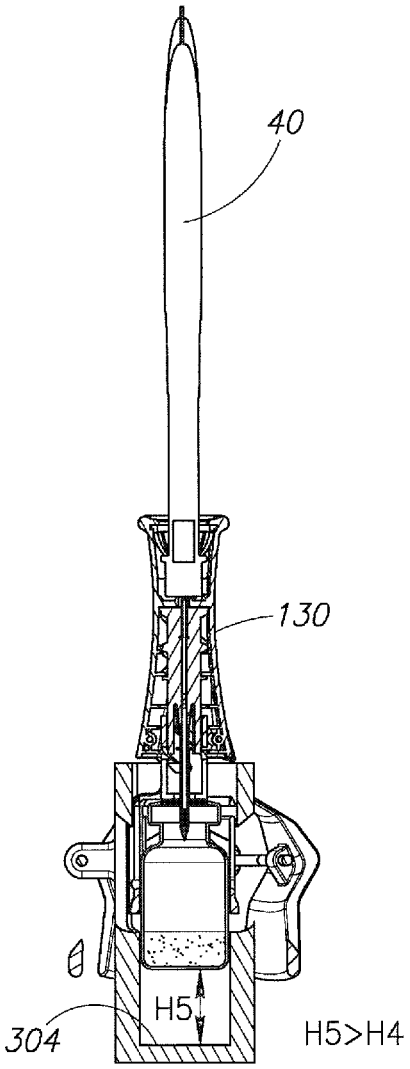
FIG. 23B is a longitudinal cross section of FIG. 23A's assemblage along line K-K thereon.
Figure 24:
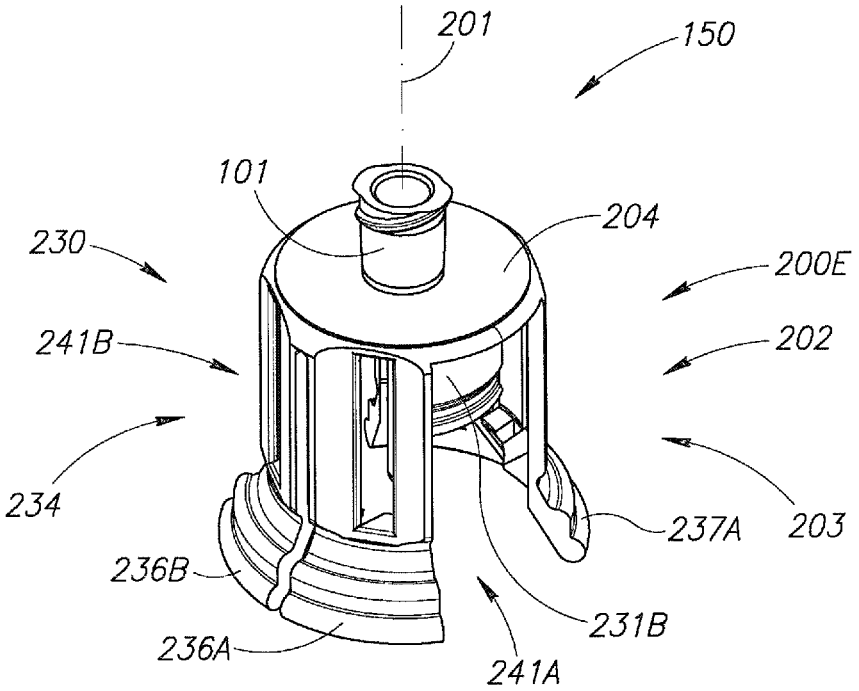
FIG. 24 is a front top perspective view of a fifth preferred embodiment of a liquid drug transfer device in accordance with the present invention.
Figure 25:
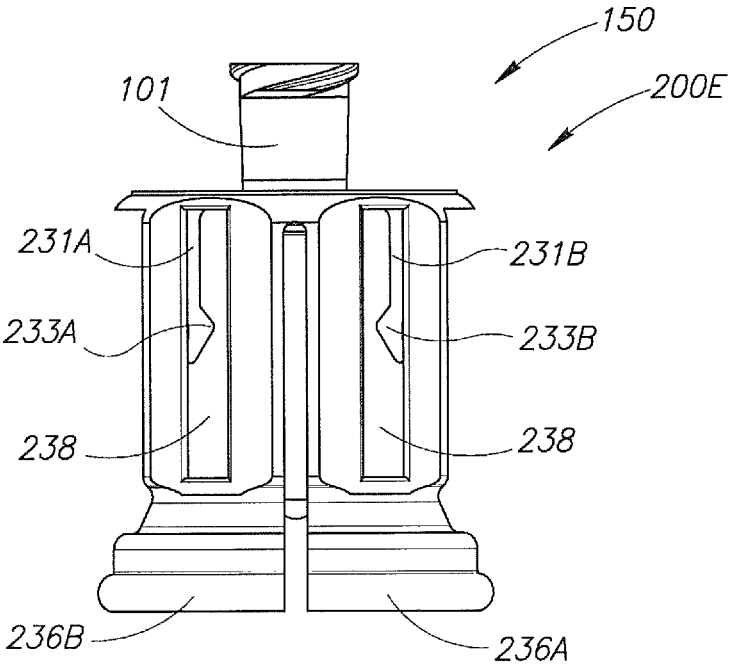
FIG. 25 is a front elevation view of FIG. 24's liquid drug transfer device.
Figure 26:
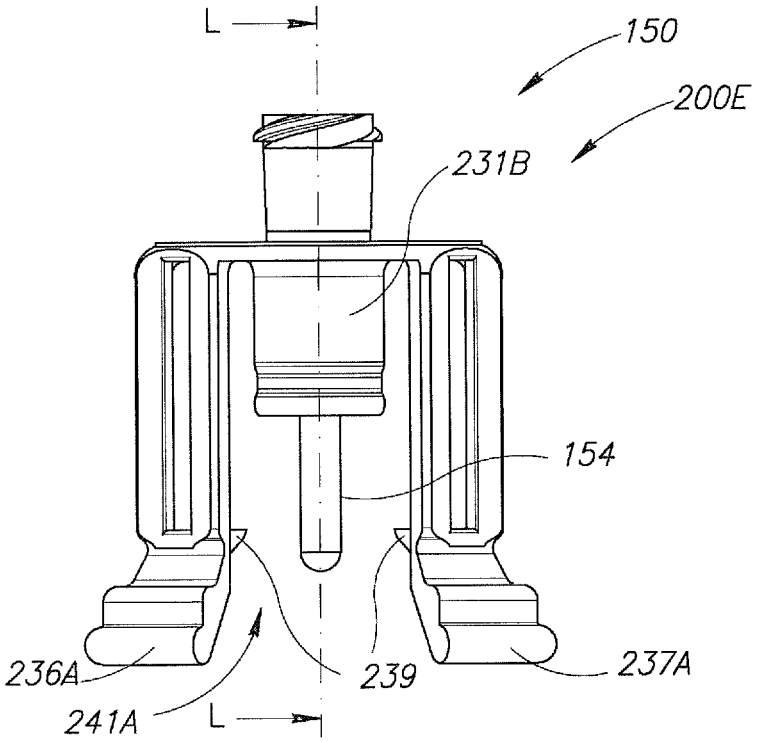
FIG. 26 is a right side elevation view of FIG. 24's liquid drug transfer device.
Figure 27:
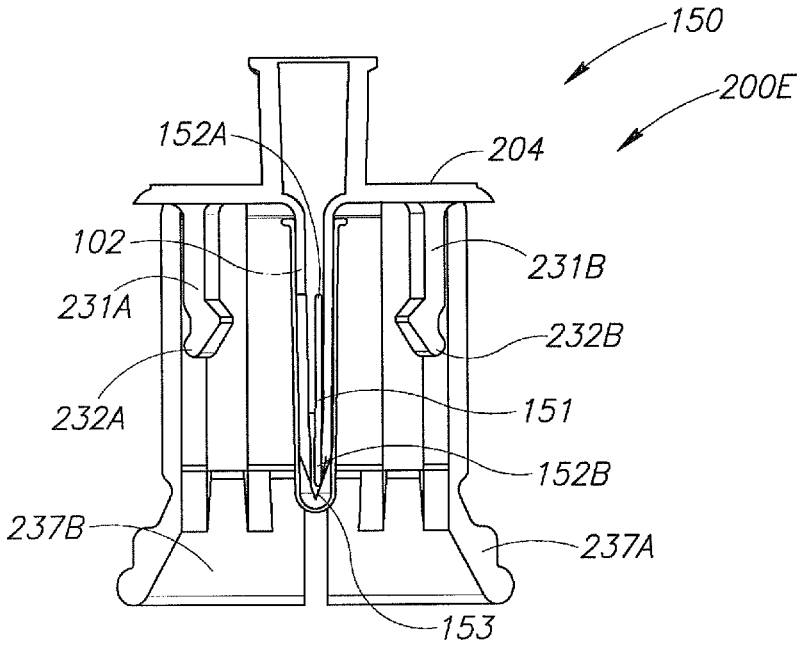
FIG. 27 is a longitudinal cross section of FIG. 24's liquid drug transfer device along line L-L on FIG. 26.

FIGS. 23A and 23B show that in the case the liquid drug transfer device 130 has been partially actuated to puncture the drug vial 20, the universal drug vial adapter 200D rests on the top rim 306 on its insertion into the drug vial release tool 300, the release members 313 are not aligned with the separations between the top wall 204 and the flex members 221, 222, 223 and 224 but rather their release member tips 314 directly face the flex members 221, 222, 223 and 224 and are therefore inoperable to release the punctured drug vial 20.

FIGS. 24 to 33 show a liquid drug transfer device 150 for use with a syringe 10, and a drug vial of a small drug vial 20A and a large drug vial 20B. The liquid drug transfer device 150 is similar to the liquid drug transfer device 100 insofar it includes a universal drug vial adapter 200E, a female Luer connector 101, and a tubular puncturing member 102 in flow communication with the female Luer connector 101 for enabling flow access to a drug vial interior 28. The universal drug vial adapter 200E is similar to the universal drug vial adapter 200A insofar it has a longitudinal drug vial adapter axis 201, a skirt 202, a drug vial cavity 203 for snugly telescopically receiving at least a top part of a drug vial 20B therein and therefore inherently a top part of a drug vial 20A, and a top wall 204 transverse to the longitudinal drug vial adapter axis 201.

The puncturing member 102 has a pair of elongated flow apertures 151 each having a proximal end 152A adjacent the top wall 204 and a distal end 152B adjacent a puncturing tip 153. The proximal ends 152A are adjacent the top wall 204 to ensure that the entire liquid contents of a drug vial 20A can be aspirated therefrom on inversion of an assemblage of the liquid drug transfer device 150 and a drug vial 20A. The distal ends 152B are adjacent the puncturing tip 153 to ensure that the puncturing member 102 is in flow communication with a drug vial 20B's drug vial interior 28 in an assemblage of the liquid drug transfer device 150 and a drug vial 20B.

Figure 29:
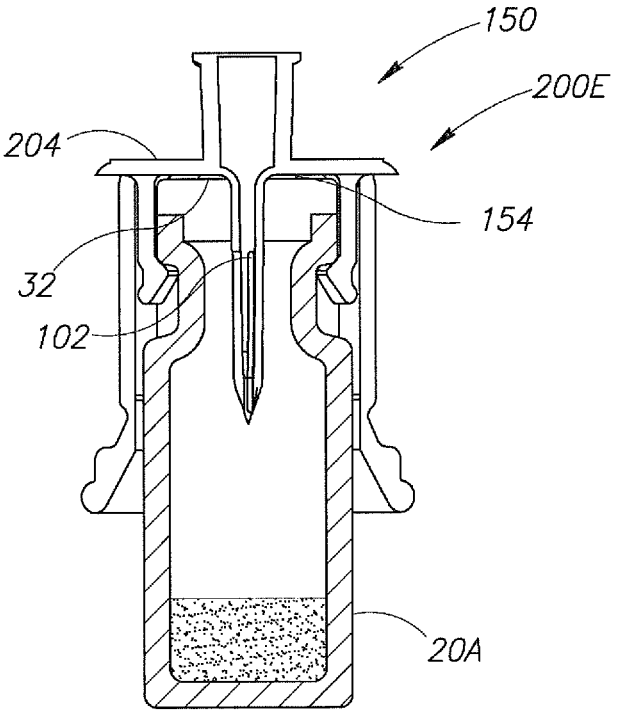
FIG. 29 is a longitudinal cross section of FIG. 28's assemblage along line M-M thereon.
Figure 31:
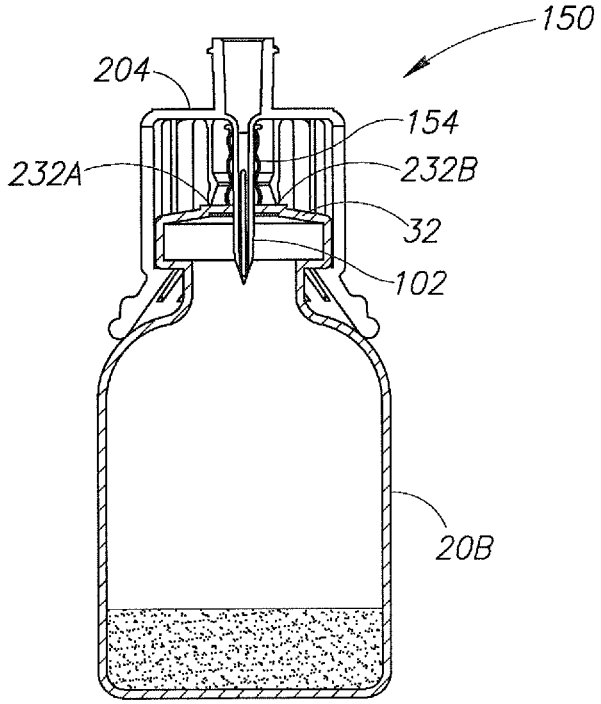
FIG. 31 is a longitudinal cross section of FIG. 30's assemblage along line N-N thereon.

The liquid drug transfer device 150 includes a thin sheath 154 covering the puncturing member 102. The sheath 154 is urged towards the top wall 204 on mounting the liquid drug transfer device 150 on a drug vial 20A and a drug vial 20B. In the former case, FIG. 29 shows the sheath 154 is flattened between the top wall 204 and the drug vial 20A's uppermost drug vial surface 32. In the latter case, FIG. 31 shows the sheath 154 takes on a bellows like appearance between the top wall 204 and the drug vial 20B's uppermost drug vial surface 32. The sheath 154 acts as a sealing member for sealing the proximal ends 152A of the elongated flow apertures 151 which are exposed between the top wall 204 and the drug vial 20B's uppermost drug vial surface 32.

The skirt 202 includes a set of minor flex members 230 for telescopically clamping on a drug vial 20A's drug vial head. The set of minor flex members 230 includes a pair of opposite minor flex members 231A and 231B for telescopically clamping on a drug vial 20A's drug vial head 24. The minor flex members 231 each have a free minor flex member end 232A and 232B distal from the top wall 204 and an inner directed rim 233A and 233B for snap fitting on a drug vial 20A's drug vial head 24.

The skirt 202 includes a set of major flex members 234 for telescopically clamping on a drug vial 20B's drug vial closure 33. The set of major flex members 234 includes a first pair of adjacent major flex members 236A and 236B and a second pair of adjacent major flex members 237A and 237B opposite the first pair of adjacent major flex members 236A and 236B. The set of major flex members 234 includes pairs of adjacent major flex members 236 and 237 for ensuring they clamp two opposite major lengths of the periphery of a drug vial 20B's drug vial closure 33.

The major flex members 236 and 237 are each formed with a longitudinal directed window 238 and an inner directed rim 239 for snap fitting on a drug vial 20B's drug vial closure 33. The major flex members 236A and 237A are spaced apart to leave a separation 241A therebetween. The major flex members 236B and 237B are spaced apart to leave a separation 241B therebetween. The minor flex members 231 are aligned with the separations 241 whereby, on telescopically clamping the liquid drug transfer device 150 on a drug vial 20A, the minor flex members 231 are unhindered by the major flex members 236 and 237 to outwardly flex relative to the longitudinal drug vial adapter axis 201.

Figure 28:
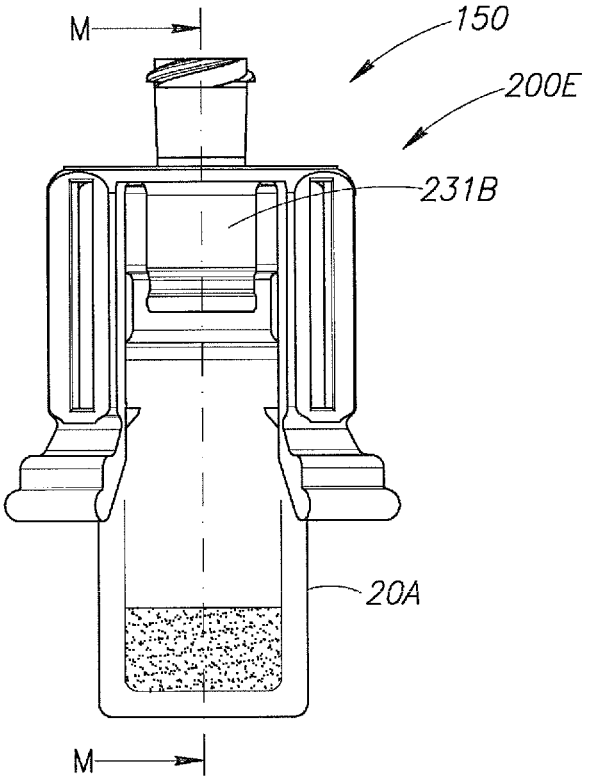
FIG. 28 is a right side elevation view of FIG. 24's liquid drug transfer device telescopically clamped on a small drug vial.

FIGS. 28 and 29 show the liquid drug transfer device 150 mounted on a drug vial 20A. The puncturing member 102 entirely punctures through its drug vial stopper 31 such that the proximal ends 152A are within its drug vial interior 28.

Figure 30:
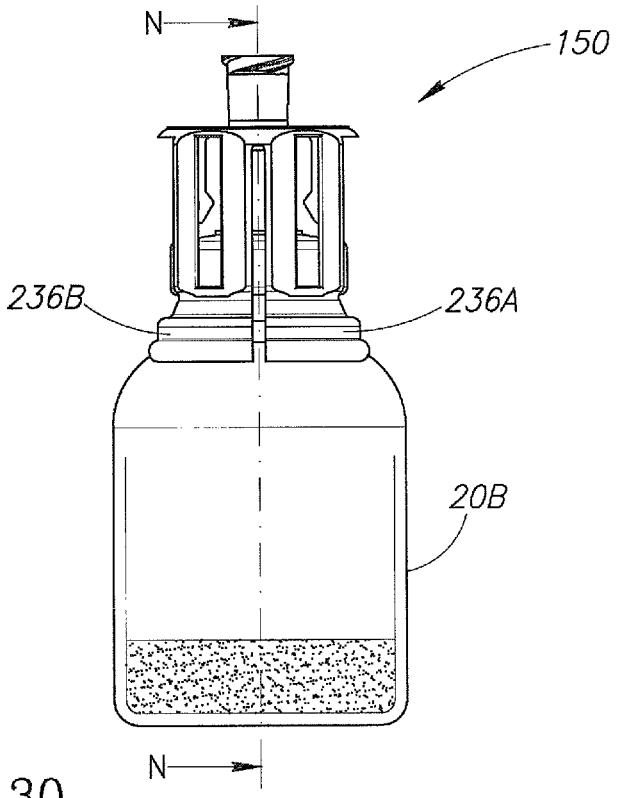
FIG. 30 is a front elevation view of FIG. 24's liquid drug transfer device mounted on a large drug vial.

FIGS. 30 and 31 show the liquid drug transfer device 150 mounted on a drug vial 20B. The set of minor flex members 230 acts as an abutment member to distance the drug vial 20B from the top wall 204 whereupon the drug vial 20B's uppermost drug vial surface 32 underlies the minor flex member free ends 232A and 232B.

The top portion of puncturing member 102 remains exposed between the top wall 204 and the drug vial's uppermost drug vial surface 32. The sheath 154 assumes a bellows like appearance between the top wall 204 and the drug vial 20B's uppermost drug vial surface 32 for acting as a sealing member for the exposed lengths of the elongated flow apertures 151.

Figure 32:
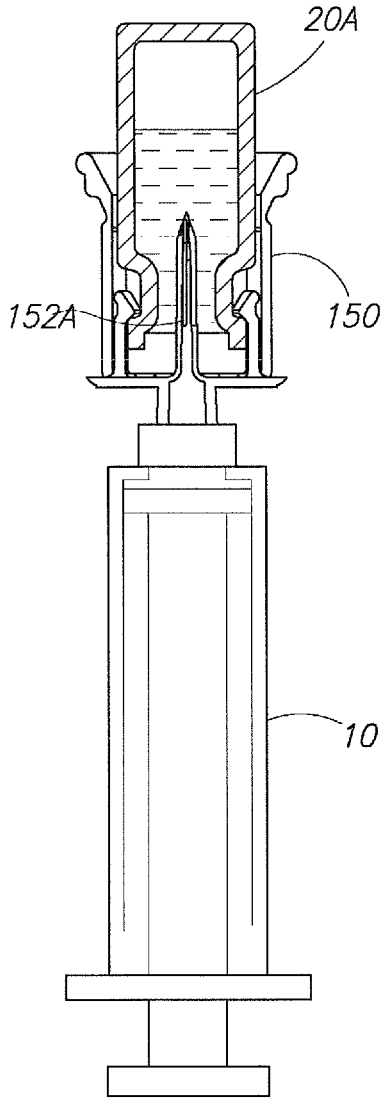
FIG. 32 is a pictorial view showing syringe aspiration of liquid contents from FIG. 28's assemblage.

FIG. 32 shows a syringe 10 attached to the liquid drug transfer device 150 mounted on a drug vial 20A for mixing, reconstitution and aspiration purposes.

Figure 33:
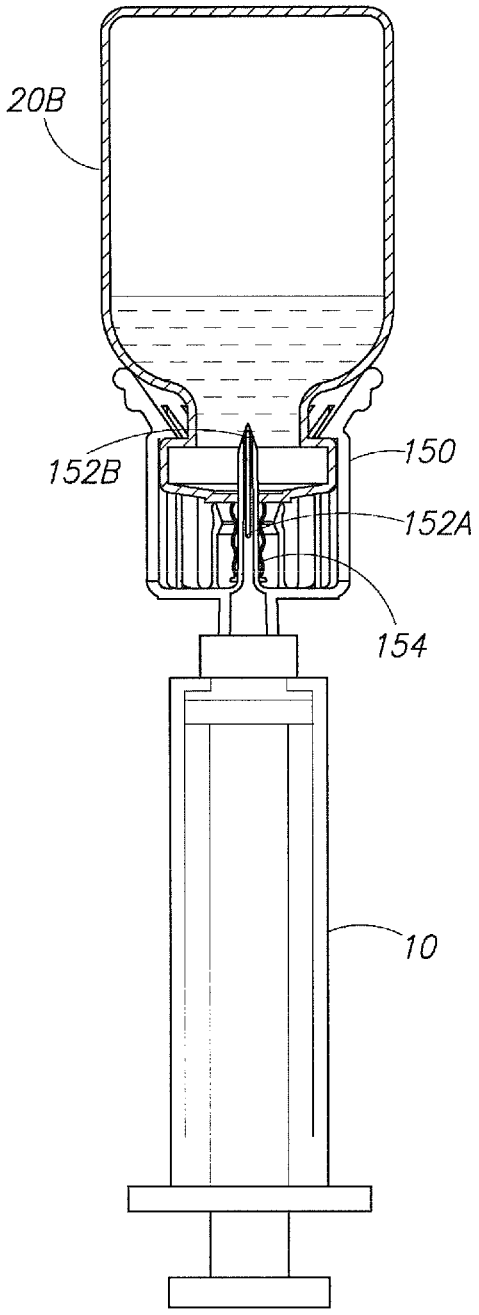
FIG. 33 is a pictorial view showing syringe aspiration of liquid contents from FIG. 30's assemblage.

FIG. 33 shows a syringe 10 attached to the liquid drug transfer device 150 mounted on a drug vial 20B for mixing, reconstitution and aspiration purposes.

Figure 34:
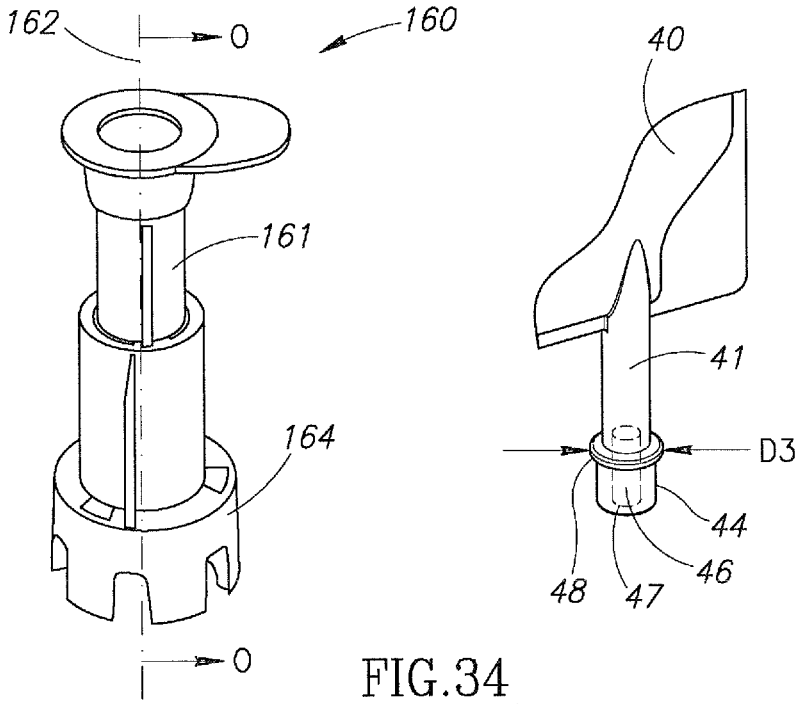
FIG.34 (PRIOR ART)
FIG. 34 is a front perspective view of a conventional liquid drug transfer device for attaching to an injection port.

FIG. 34 shows a liquid drug transfer device 160 with an injection port connector 230 for mounting on a particular sized injection port 41 having an injection port tip 44 with a self-sealing plug 46, an exposed plug surface 47 and a trailing injection port tip rim 48. The liquid drug transfer device is commercially available under the trade name VIAL-MATE Adaptor Device from Baxter Healthcare Corporation. The product sheet is available online at http://www.baxtermedictiondeliveryproducts.com/drug-delivery/vialmate.html.

The product sheet indicates that the VIAL-MATE Adaptor Device is suitable only for single dose vials with 20 mm closure and VIAFLEX containers also available from Baxter Healthcare Corporation.

Figure 35:
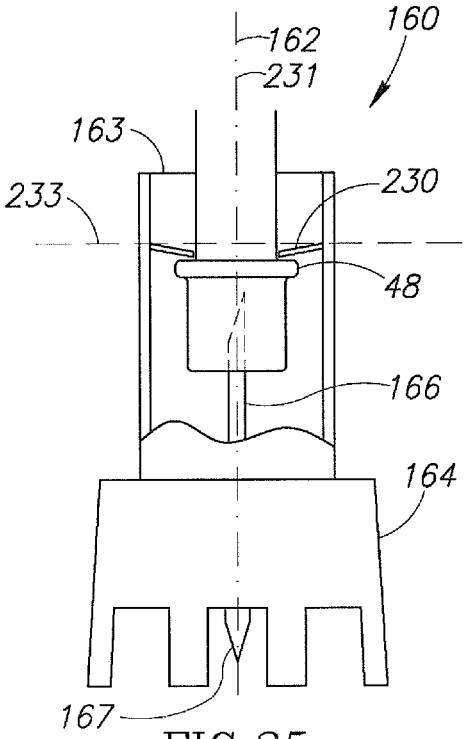
FIG.35 (PRIOR ART)
FIG. 35 is a longitudinal cross section of FIG. 34's liquid drug transfer device along line O-O thereon deployed with a conventional injection port connector for attaching to an injection port.

FIG. 35 shows the liquid drug transfer device 160 includes an open-ended housing 161 having a longitudinal housing axis 162, an access aperture 163 and a vial adapter 164. The open ended housing 161 includes a needle 166 for puncturing an injection port 41 and a puncturing member 167 downward depending into the vial adapter 164 in flow communication with the needle 166.

Figure 36:
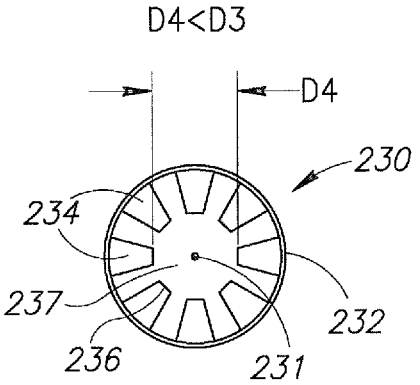
FIG.36 (PRIOR ART)
FIG. 36 is a top view of FIG. 35's conventional injection port connector.

FIG. 36 shows a conventional injector port connector 230 deployed in the open ended housing 161 towards the access aperture 163. The injector port connector 230 includes a longitudinal connector axis 231 in co-axial alignment with the longitudinal housing axis 162. The injection port connector 230 includes a circular support ring 232 defining a horizontal plane 233 transverse to the longitudinal housing axis 162. The support ring 232 includes a multitude of straight connector members 234 each terminating in a free connector member end 236 disposed toward the longitudinal housing axis 162. The free connector member ends 236 converge to define a generally circular connector aperture 237 underlying the horizontal plane 233. The connector aperture 237 has a connector aperture diameter D4 where D4<D3.

The liquid drug transfer device 160 is designed for a particular sized injection port 41 to be forcibly slidingly inserted through the connector aperture 237 from the direction of the access aperture 163 towards the vial adapter 164 whereupon the free connector member ends 236 snap behind the trailing injection port tip rim 48. However, the injection port 41 is undesirably capable of being readily withdrawn from the open-ended housing 161 on application of a relatively small outward longitudinal withdrawal force in the direction of the access aperture 163.

Figure 37:
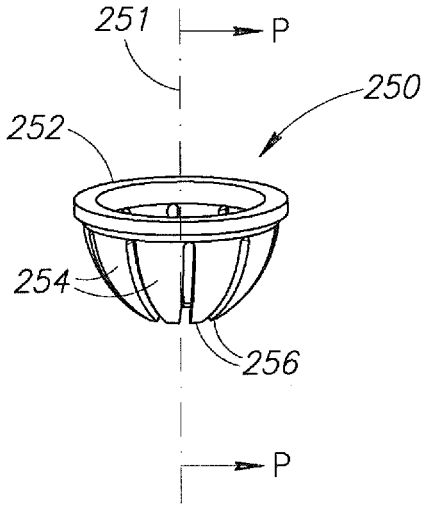
FIG. 37 is a perspective view of a universal injection port connector in accordance with the present invention.
Figure 38:
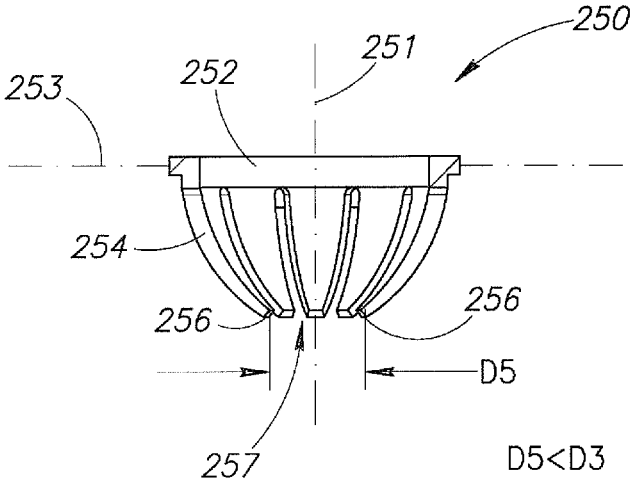
FIG. 38 is a longitudinal cross section of FIG. 37's universal injection port connector along line P-P thereon.

FIGS. 37 and 38 show a universal injection port connector 250 for mounting on different sizes of injection ports 41. The universal injection port connector 250 has the same basic construction as the injector port connector 230 as follows: The universal injection port connector 250 has a longitudinal axis 251, a closed support ring 252 defining a horizontal plane 253, a multitude of connector members 254 each resiliently flexibly mounted on the support ring 252 and terminating in a free connector member end 256 converging towards a connector aperture 257 parallel to the horizontal plane 253. The closed support ring 252 is preferably circular but can be formed in other closed shapes, for example, oval, and the like.

The universal injection port connector 250 differs from the conventional injection port connector 230 insofar as the former has curved connector members 254 as opposed to the latter's straight connector members 234 such that the universal injection port connector 250 assumes an overall bowl like shape. The connector aperture 257 has a connector aperture diameter D5 where D5<D3 such that forced sliding insertion of an injection port tip 44 through the connector aperture 257 from the direction of the support ring 252 outwardly flexes the connector members 254 from their non-flexed position relative to the longitudinal connector axis 251 for snapping behind the trailing injection port rim 48, thereby precluding sliding withdrawal of the injection port tip 44 in a reverse direction to the forced sliding insertion. By virtue of the curved shape of its connector members 254, the universal injection port connector 250 is capable of being attached on different sizes of injection ports 41. Moreover, by virtue of its curved connector members 254, the universal injection port connector 250 is more capable of withstanding an outward longitudinal withdrawal force than the conventional injection port connector 230.

Figure 39:
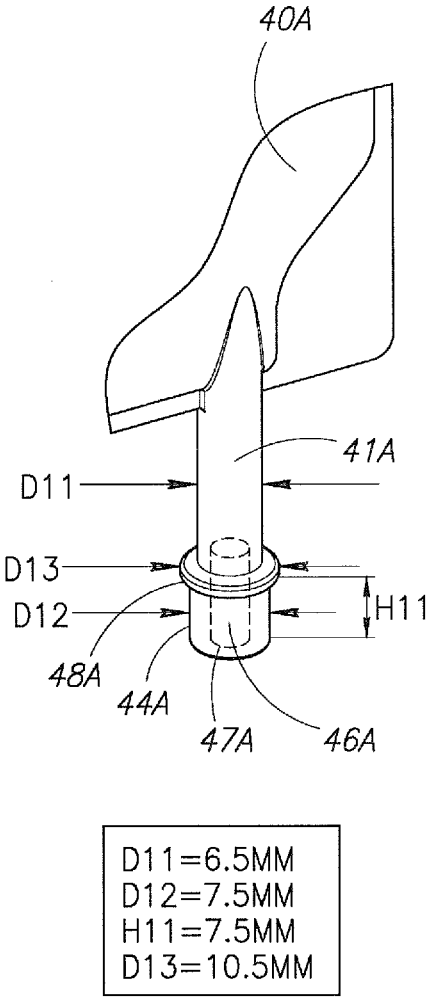
FIG. 39 is a front perspective view of an infusion bag with a so-called small injection port.

FIG. 39 shows an infusion bag 40A having a so-called small injection port 41A having an injection port tip 44A with a self-sealing plug 46A, an exposed plug surface 47A and a trailing injection port tip rim 48. The injection port 41A has an external diameter D11. The injection port tip 44A has an external tip diameter D12 and a tip height H11. The trailing injection port tip rim 48A has an external diameter D13. D11 is 6.5 mm, D12 is 7.5 mm, H11 is 7.5 mm and D13 is 10.5 mm.

Figure 40:
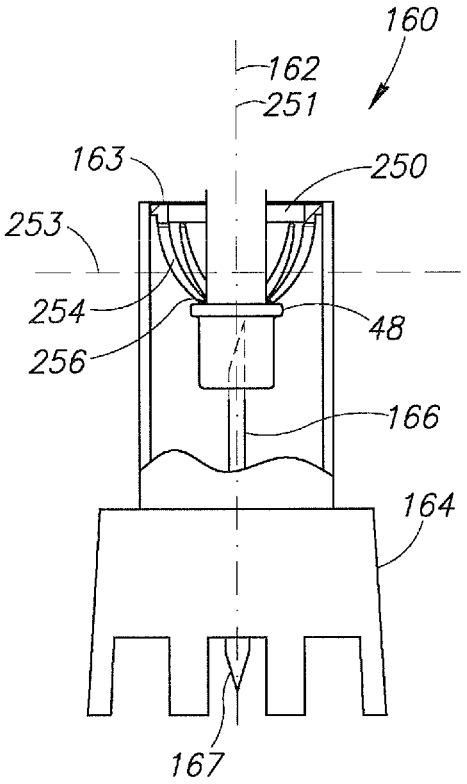
FIG. 40 is a longitudinal cross section of FIG. 34's liquid drug transfer device with FIG. 37's universal injection port connector mounted on FIG. 39's small injection port.

FIG. 40 shows the liquid drug transfer device 160 with the universal injection port connector 250 attached on the small injection port 41A.

Figure 41:
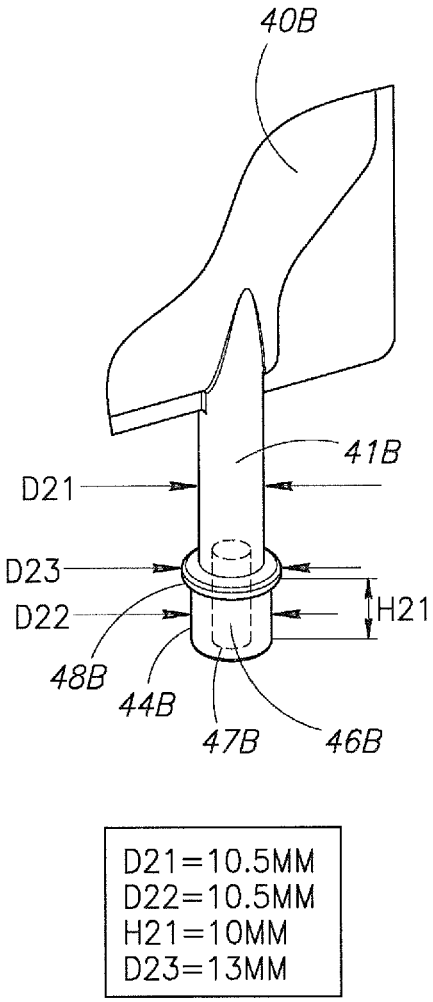
FIG. 41 is a front perspective view of an infusion bag with a so-called large injection port tip.

FIG. 41 shows an infusion bag 40B having a so-called large injection port 41B with the same construction as the small injection port 41A but with larger dimensions as follows: The injection port 41B has an external diameter D21. The injection port tip 44B has an external tip diameter D22 and a tip height H21. The trailing injection port tip rim 48B has an external diameter D23. D21 is 10.5 mm, D22 is 10.5 mm, H21 is 10 mm and D23 is 13 mm.

Figure 42:
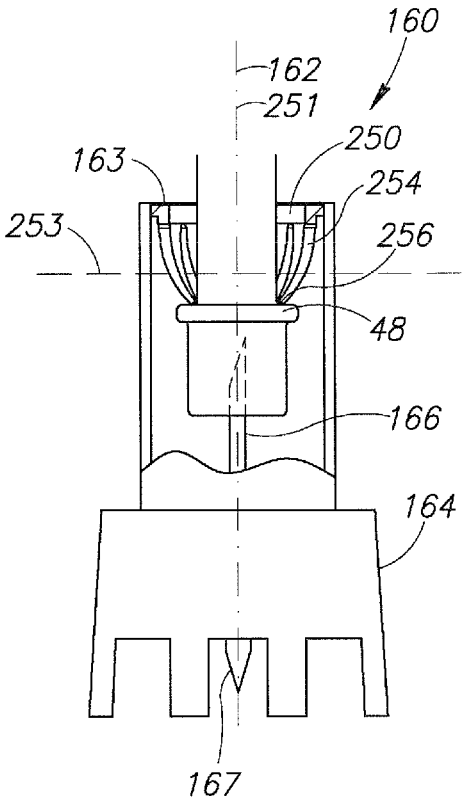
FIG. 42 is a longitudinal cross section of FIG. 34's liquid drug transfer device with FIG. 37's universal injection port connector mounted on FIG. 41's large injection port.

FIG. 42 shows the liquid drug transfer device 160 with the universal injection port connector 250 attached on the large injection port 41B. The connector members 254 are more steeply inclined when attaching the liquid drug transfer device 160 on the injection port 41B than the injection port 41A since the former 41B has a wider injection port diameter D21 than the latter 41A's injection port diameter D11.

While the invention has been described with respect to a limited number of embodiments, it will be appreciated that many variations, modifications, and other applications of the invention can be made within the scope of the appended claims.

The invention claimed is:

1. A liquid drug transfer device for use with an infusion bag containing an infusion liquid and having an injection port, the injection port terminating in an injection port tip containing a self-sealing plug with an exposed plug surface, the injection port tip having a trailing injection port rim, the liquid drug transfer device comprising an open ended housing having a longitudinal housing axis and including a universal injection port connector, said universal injection port connector having a longitudinal connector axis co-directional with said longitudinal housing axis and a closed support ring defining a horizontal plane transverse to said longitudinal connector axis, said support ring having a multitude of curved connector members resiliently flexibly mounted thereon and a free connector member end converging towards a connector aperture underlying said support ring from a direction of said open ended housing such that said universal injection port connector assumes an overall bowl like shape, the arrangement being such that on forced sliding insertion of the injection port tip through said connector aperture into said open ended housing, the injection port tip outwardly flexes said multitude of connector members from their non-flexed position relative to said connector axis for snapping behind the trailing injection port rim, thereby precluding outward sliding withdrawal of the injection port tip from said open ended housing in a reverse direction to said forced sliding insertion.

* * * * *